United States Patent [19]

Michl et al.

[11] Patent Number: 4,899,653

[45] Date of Patent: Feb. 13, 1990

[54] MICROPROCESSOR-BASED PRESS DAMPENING CONTROL

[75] Inventors: Kurt D. Michl, Homewood; Allen L. Mitchell, Downers Grove; Patrick J. Ahern, Oak Lawn; Scott P. Letellier, Riverdale, all of Ill.

[73] Assignee: Rockwell International Corporation, Pittsburgh, Pa.

[21] Appl. No.: 191,621

[22] Filed: May 9, 1988

[51] Int. Cl.[4] ..... B41F 7/30; B41L 25/06; B41L 25/02

[52] U.S. Cl. ..... 101/148; 101/366

[58] Field of Search ..... 101/148, 147, 350, 364, 101/210, 208, 366, 365; 118/674, 697, 696, 699, 300, 259, 706, 313; 239/550; 137/266, 624.18, 624.11; 346/75

[56] References Cited

U.S. PATENT DOCUMENTS

| | | | |
|---|---|---|---|
| 4,064,801 | 12/1977 | Switall | 101/147 |
| 4,469,024 | 9/1984 | Schwartz et al. | 101/147 |
| 4,649,818 | 3/1987 | Switall et al. | 101/147 |
| 4,797,686 | 1/1989 | Holder | 346/75X |

*Primary Examiner*—J. Reed Fisher

*Attorney, Agent, or Firm*—Quarles & Brady

[57] ABSTRACT

A control system for an offset printing press includes a microprocessor-based dampener, register and ink (drink) processor which controls color register, inkrate and damprate. Damprate curve data, flood requests and adjustments to individual nozzles on the spraybar can be downloaded from a master work station to the drink processor and used to control the rate at which the spraybar nozzles are pulsed on and the duration that each separate nozzle remains on.

19 Claims, 16 Drawing Sheets

SPEED FEEDBACK PROCESS

DAMPRATE CONTROL PROCESS

MICROPROCESSOR-BASED PRESS DAMPENING CONTROL

BACKGROUND OF THE INVENTION

The present invention relates to offset printing presses and, particularly, to the electronic control of such presses.

Web offset printing presses have gained widespread acceptance by metropolitan daily as well as weekly newspapers. Such presses produce a quality black and white or color product at very high speeds. To maintain image quality, a number of printing functions must be controlled very precisely as the press is operating. These include the control of press speed, the control of color register, the control of ink flow and the control of dampening water.

In all printing processes there must be some way to separate the image area from the non-image area. This is done in letterpress printing by raising the image area above the non-image area and is termed "relief printing". The ink roller only touches the high part of the plate, which in turn, touches the paper to transfer the ink. In offset lithography, however, the separation is achieved chemically. The lithographic plate has a flat surface and the image area is made grease-receptive so that it will accept ink, and the non-image area is made water-receptive so it will repel ink when wet.

In a web offset printing press the lithographic plate is mounted to a rotating plate cylinder. The ink is injected onto an ink pickup roller and from there it is conveyed through a series of transfer rollers which spread the ink uniformly along their length and transfer the ink to the image areas of the rotating plate. Similarly, dampening water is applied to a fountain roller and is conveyed through one or more transfer rollers to the non-image areas of the rotating plate cylinder. The plate cylinder rotates in contact with a blanket cylinder which transfers the ink image from the plate cylinder to the moving paper web.

It is readily apparent that the amount of ink and dampening water supplied to the plate cylinder is directly proportional to the press speed. At higher press speeds the plate cylinder and blanket cylinder transfer ink and water to the paper web at a higher rate, and the inking and dampening systems must, therefore, supply more ink and water. It is also well known that this relationship is not linear and that the rate at which ink and dampening water is applied follows a complex rate curve which is unique to each press and may be unique to each run on a press. Not so apparent is the fact that the ink and water may be applied nonuniformly across the width of the ink pickup roller and the fountain roller in order to achieve uniform printing quality along the width of the web. If this is not done, there may be significant changes in the quality of the printed images across the width of the moving web.

Prior press control systems have provided limited control over the rate at which dampening water has been applied as a function of press speed. These systems pulse the nozzles on the spraybar on and off at one of a plurality of selectable pulse rates. The particular pulse rate selected is determined by the press speed. The particular pulse rates and selection points between pulse rates is preset to follow the dampening rate curve of the press as closely as possible. There is no means for easily changing these values or for providing a continuous range of pulse rates which closely follow the rate curve.

In addition, while the amount of dampening water applied by the spraybar can be adjusted over the width thereof, this is a manual adjustment which may only be made locally at a spraybar controller. Thus, if inconsistencies in print quality are observed over the width of the image, manual adjustments to the circuitry must be made at a local control panel.

SUMMARY OF THE INVENTION

The present invention relates to a control system for an offset printing press and, particularly, to the control of a dampening system on such a press.

The dampening control system of the present invention includes a communications link with the press control system that enables dampening control parameters, such as dampening rate curve data, flood request data and spraybar nozzle pulse width data, to be downloaded and acted upon. The pulse width applied to energize each spraybar nozzle is separately controlled by presettable counter means which can be changed by downloaded data while the press is running. The spraybar nozzles are energized by pulse rate means which produces pulses at a rate determined by calculation means that interpolates between the data points in the downloaded dampening rate curve.

A general object of the invention is to provide a flexible dampening water control system which can be configured and adjusted by downloading data from a master work station or a local control panel. The dampening water control system includes a microprocessor which is programmed to carry out the various control functions using data which is stored in a read/write memory. The data stored in this memory can be changed by messages which are received from the master work station or the local control panel. As a result, the operating parameters of the dampening water control system can be easily altered even while the microprocessor is carrying out its control functions.

A more specific object of the invention is to enable the dampening rate curve data which controls nozzle pulse rate as a function of press speed to be changed. The rate curve data which is used to calculate the nozzle pulse rate is stored in the read/write memory. This data may be easily changed by the microprocessor when new rate curve data is received from the master work station through the communications link.

Yet another general object of the invention is to control the nozzle pulse rate such that it more accurately follows the dampening rate curve defined by the dampening rate curve data. The rate curve data provides discrete data points on the dampening rate curve which each relate a pulse rate to a press speed. The calculation means receives a press speed value from press speed feedback means and identifies the two data points which straddle this press speed value. Using the press speed, the calculation means interpolates between these two data points to determine the desired nozzle pulse rate which is then used to operate the pulse rate means.

Yet another object of the invention is to enable the pulse widths of each spraybar nozzle to be separately controlled and easily adjusted. The desired pulse width of each nozzle is stored in the read/write memory and is output to the presettable counter associated with the spraybar nozzle. When a SET message or a CHANGE message is received through the communications link, this stored pulse width data is altered in accordance with the downloaded information. The microprocessor then updates the appropriate presettable counters such that the altered nozzle pulse rates will be produced.

Still another object of the invention is to control the flood function from the master work station. When a flood request message is received through the communications link, a flood timer value stored in the read/-write memory is preset to a value indicated in the message. The flood timer value is decremented in response to signals from a real time clock means and during the indicated time interval the pulse widths of each controlled nozzle is incremented a preselected amount to increase the amount of dampening water applied to the plate cylinder.

A more specific object of the invention is to provide a press speed feedback signal which is stored in the read/write memory for use by the calculation means. An incremental position feedback device produces a pulse for each increment of press motion. A counter is energized to count a preset number of incremental feedback pulses and a timer records the time interval required to receive the preset number of feedback pulses. The microprocessor periodically reads the timer value and converts it to a velocity which is stored in the read/write memory.

Yet another object of the invention is to provide a spraybar nozzle control circuit which pulses the nozzles on at a commanded rate and which turns them off separately after commanded time intervals. A presettable counter is associated with each nozzle and can be separately configured to preset to a specific value each time the nozzles are pulsed on. These counters are operated to act as timers which expire to turn off their respective nozzles independently at times determined by their presettable values.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
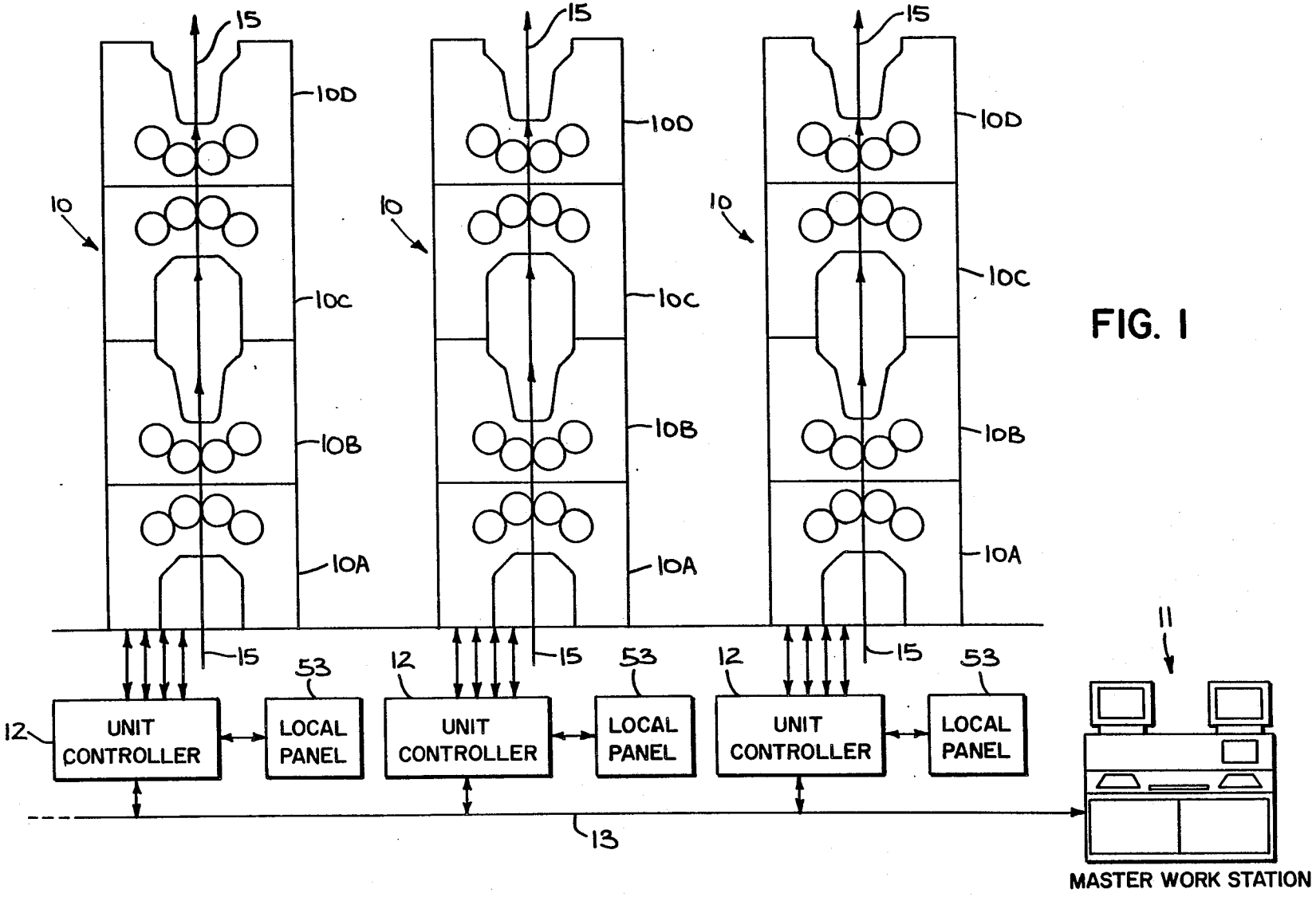
FIG. 1 is a schematic representation of a web offset printing press and its control system.

Referring particularly to FIG. 1, a printing press is comprised of one or more printing units 10 which are controlled from a master work station 11. Each printing unit is linked to the master work station by a unit controller 12 which communicates through a local area network 13. As described in U.S. Pat. No. 4,667,323, the master work station 11 and the unit controllers 12 may send messages to each other through the network 13 to both control the operation of the press and to gather production information.

Figure 2:
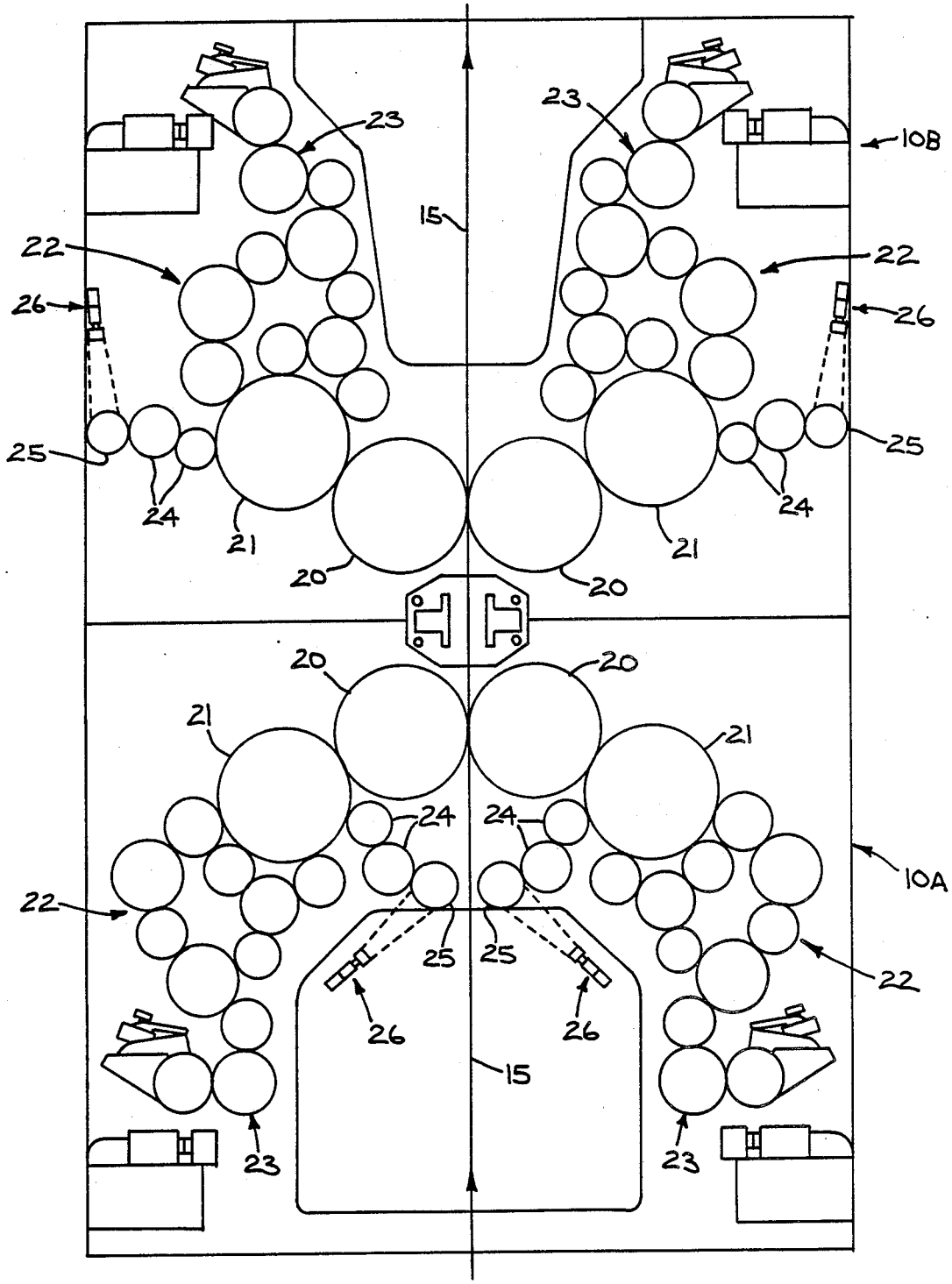
FIG. 2 is a schematic representation of two printing units in the press of FIG. 1.

Referring particularly to FIGS. 1 and 2, each printing unit 10 is comprised of four units which are referred to as levels A, B, C and D and which are designated herein as units 10A, 10B, 10C and 10D. The units 10A–D are stacked one on top of the other and a web 15 passes upward through them for printing on one or both sides. In the preferred embodiment shown, the printing units 10 are configured for full color printing on both sides of the web, where the separate units 10A–D print the respective colors blue, red, yellow and black.

As shown best in FIG. 2, each unit 10A–D includes two printing couples comprised of a blanket cylinder 20 and a plate cylinder 21. The web 15 passes between the blanket cylinders 20 in each unit for printing on both sides. Ink is applied to each plate cylinder 21 by a series of ink transfer rollers 22 which receive ink from an ink pickup roller 23. As is well known in the art, the ink transfer rollers 22 insure that the ink is distributed uniformly along their length and is applied uniformly to the rotating plate cylinder 21. Similarly, each plate cylinder 21 is supplied with dampening water by a pair of dampener transfer rollers 24 and a dampener rider roller 25. A spray bar assembly 26 applies dampening water to each of the dampener rider rollers 25 as will now be described in more detail.

Figure 3:
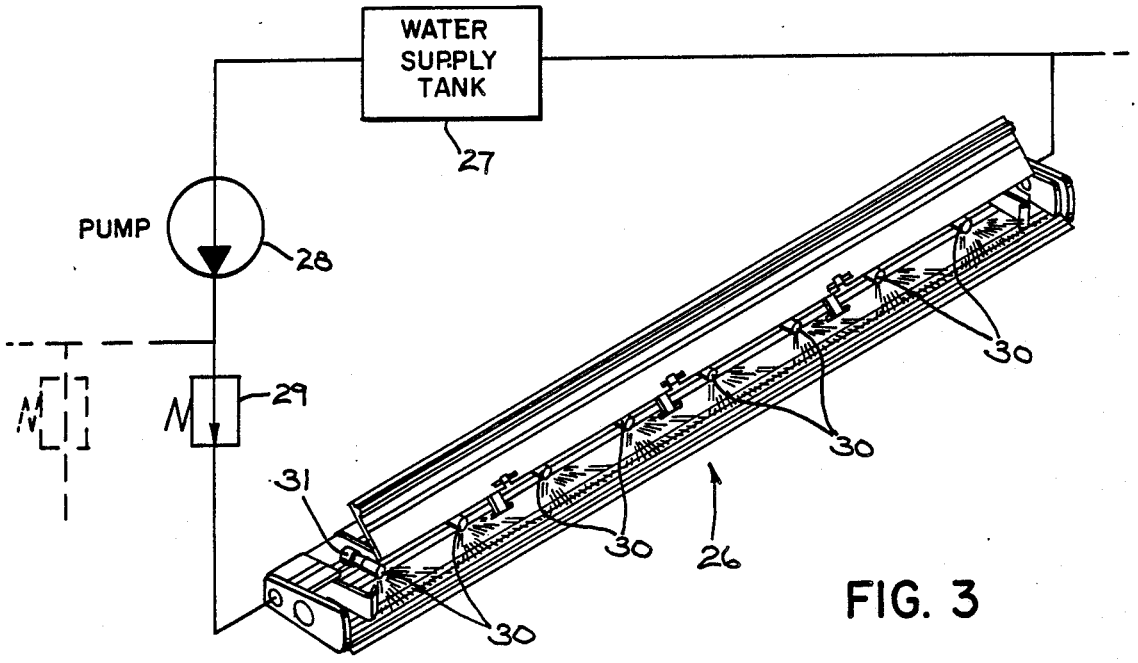
FIG. 3 is a pictorial view of a dampening water spray bar which is employed in the printing units of FIG. 2.

Referring particularly to FIG. 3, each spray bar assembly 26 receives a supply of pressurized water from a water supply tank 27 through a pump 28 and solenoid valve 29. The spray bar assembly 26 includes eight nozzles 30 which each produce a flat, fan-shaped spray pattern of water when an associated solenoid valve 31 is energized. When all eight solenoid valves 31 are energized, a thin line of water is sprayed along the entire length of the associated dampener rider roller 25. As is well known in the art, the solenoid valves 31 are pulsed on and off at a rate which is proportional t press speed so that the proper amount of dampening water is applied and transferred to the plate cylinder 21. It is also well known that means must be provided for separately adjusting the amount of water sprayed by each nozzle 30 to account for variations in the distribution of dampening water over the length of the plate cylinder 21.

Figure 4:
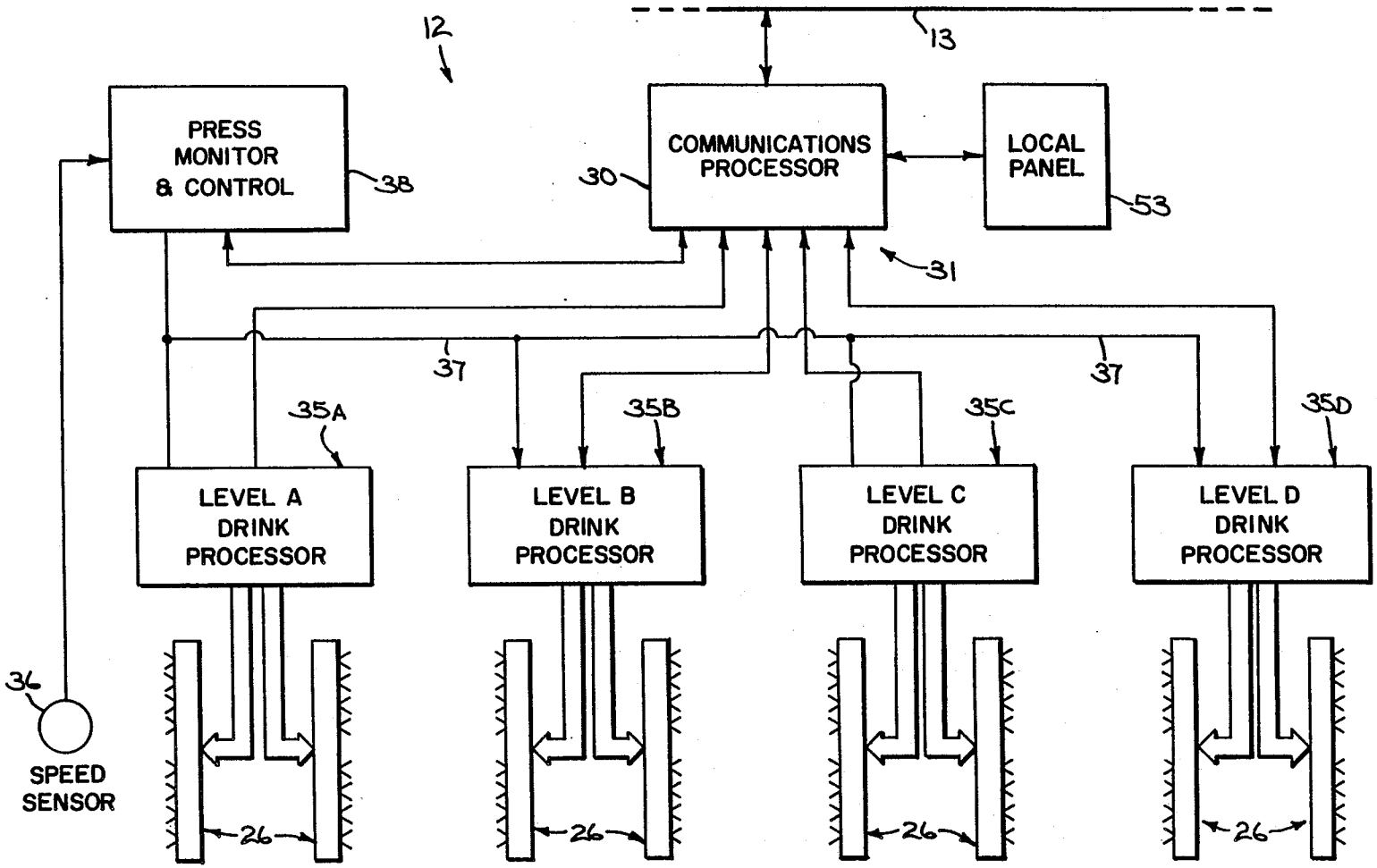
FIG. 4 is an electrical block diagram of a unit controller which forms part of the press control system of FIG. 1.

Referring to FIGS. 1 and 4, the spray bars 26 are operated by the unit controllers 12. Each unit controller includes a communications processor 30 of the type disclosed in the above-cited U.S. Pat. No. 4,667,323 which interfaces with the local area network 13. The communications processor 30 provides six serial communications channels 31 through which it can receive input messages for transmission on the network 13. Messages which are received through the network 13 by the communications processor 30 are distributed to the appropriate serial channel 31. The serial communications channels 31 employ a standard RS 422 protocol.

Four of the serial channels 31 connect to respective drink processors 35A, 35B, 35C and 35D. Each drink processor 35 is coupled to sensing devices and operating devices on a respective one of the levels A–D of the printing unit 10. A press speed feedback signal is received by each drink processor 35 through a pair of lines 37 from a press monitor and control 38 and speed sensor 36 mounted on the units 10A. Each drink processor 35A–D also produces output signals which control the solenoid valves 31 on the spray bars 26. The drink processors 35A–D also control the application of ink to the ink pickup rollers 23 and control color register, but these functions will not be described in any detail in this specification.

DESCRIPTION OF THE HARDWARE

Figure 5:
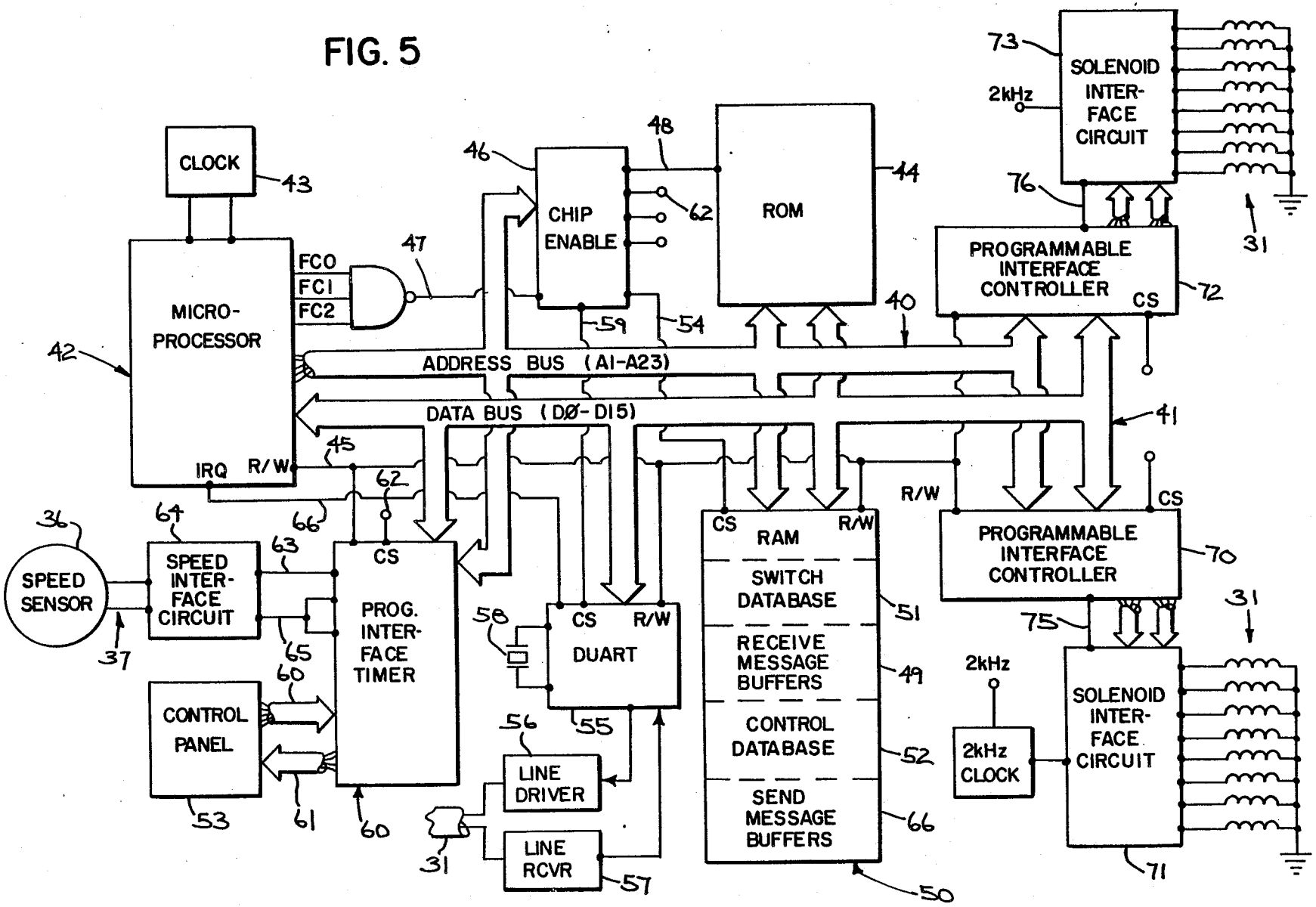
FIG. 5 is an electrical schematic diagram of a dampener, register, ink ("drink") processor which forms part of the unit controller of FIG. 4.

Referring particularly to FIG. 5, each drink processor 35 is structured about a 23-bit address bus 40 and a 16-bit data bus 41 which are controlled by a 16-bit microprocessor 42. The microprocessor 42 is a model 68000 sold commercially by Motorola, Inc. which is operated by a 10 mHz clock 43. In response to program instructions which are stored in a read-only memory (ROM) 44, the microprocessor 42 addresses elements of the drink processor 35 through the address bus 40 and exchanges data with the addressed element through the data bus 41. The state of a read/write (R/W) control line 45 determines if data is read from the addressed element or is written to it. Those skilled in the art will recognize that the addressable elements are integrated circuits which occupy a considerable address space. They are enabled by a chip enable circuit 46 when an address within their range is produced on the address bus 40. The chip enable circuit 46 is comprised of logic gates and three PAL16L8 programmable logic arrays sold commercially by Advanced Micro Devices, Inc. As is well known in the art, the chip enable circuit 46 is responsive to the address on the bus 40 and a control signal on a line 47 from the microprocessor 42 to produce a chip select signal for the addressed element. For example, the ROM 44 is enabled through a line 48 when a read cycle is executed in the address range $F00000 through $F7FFFF. The address space occupied by each of the addressable elements in the drink processor 35 is given in Table A.

TABLE A

| | | | |
|---|---|---|---|
| ROM 44 | $F00000 | to | $F7FFFF |
| RAM 50 | $000000 | to | $06FFFF |
| Programmable Interface | | | |
| Timer 60 | $300340 | to | $30037F |

TABLE A-continued

| | | | |
|---|---|---|---|
| Timer 100 | $300360 | | |
| PC0 | $300358 | | |
| PC1 | $300358 | | |
| Programmable Interface | | | |
| Controller 70 | $300380 | to | $3003BF |
| Timer 85 | $3003A0 | | |
| Port PA | $300390 | | |
| Port PB | $300392 | | |
| PC3 | $300398 | | |
| Programmable Interface | | | |
| Controller 72 | $3003C0 | to | $3003FF |
| DUART 55 | $200000 | to | $20003F |

Referring still to FIG. 5, whereas the ROM 44 stores the programs or "firmware" which operates the microprocessor 42 to carry out the functions of the drink processor 35, a read/write random access memory (RAM) 50 stores the data structures which are employed to carry out these functions. As will be described in more detail below, these data structures include elements which are collectively referred to herein as a switch database 51, a control database 52, receive message buffers 49, and send message buffers 66. For example, the switch database 51 indicates the status of various switches on the local control panels 53, whereas the control database 52 stores data indicative of press speed, nozzle pulse rate, and nozzle pulse width. The RAM 50 is enabled for a read or write cycle with the microprocessor 42 through a control line 54.

The drink processor 35 is coupled to one of the serial channels 31 of the communications processor 30 by a dual universal a synchronous receiver/transmitter (DUART) 55. The DUART 55 is commercially available as an integrated circuit model 68681 from Motorola, Inc. It operates to convert message data written to the DUART 55 by the microprocessor 42 into a serial bit stream which is applied to the serial channel 31 by a line drive circuit 56 that is compatible with the RS 422 standard. Similarly, the DUART 55 will receive a serial bit stream through a line receiver 57 and convert it to a message that may be read by the microprocessor 42. The DUART 55 is driven by a 3.6864 mHz clock produced by a crystal 58 and is enabled for either a read or write cycle through control line 59.

The press speed feedback signal as well as signals from the local control panel 53 are input to the drink processor 35 through a programmable interface timer (PIT) 60. The PIT 60 is commercially available in integrated circuit form as the model 68230 from Motorola, Inc. It provides two 8-bit parallel ports which can be configured as either inputs or outputs and a number of separate input and output points. In the preferred embodiment, one of the ports is used to input switch signals from the control panel 53 through lines 60, and the second port is used to output indicator light signals to the control panel 53 through lines 61. The PIT 60 is enabled through control line 62 and its internal registers are selected by leads A0-A4 in the address bus 40.

In addition to the parallel I/O ports, the PIT 60 includes a programmable timer/counter. This timer may be started and stopped when written to by the microprocessor 42 and it is incremented at a rate of 312.5 kHz by an internal clock driven by the 10 mHz clock 43. When the timer is started, a logic high pulse is also produced at an output 63 to a speed interface circuit 64. When the interface circuit 64 subsequently produces a pulse on input line 65, as will be described in detail below, the timer stops incrementing and a flag bit is set in the PIT 60 which indicates the timer has stopped. This flag bit is periodically read and checked by the microprocessor 42, and when set, the microprocessor 42 reads the timer value from the PIT 60 and uses it to calculate current press speed.

Referring still to FIG. 5, the solenoid valves 31 on each spray bar assembly 26 are operated through a programmable interface controller (PIC) 70 or 72 and an associated solenoid interface circuit 71 or 73. The PICs 70 and 72 are commercially available integrated circuits sold by Motorola, Inc. as the model 68230. Each includes a pair of 8-bit output registers as well as a single bit output indicated at 75 and 76. Each output register an be separately addressed and an 8-bit byte of data can be written thereto by the microprocessor 42. The two 8-bit bytes of output data are applied to the respective solenoid interface circuits 71 and 73. As will be explained in more detail below, the solenoid valves 31 are turned on for a short time period each time a pulse is produced at the single bit output of the PICs 70 and 72. This output pulse is produced each time an internal timer expires, and the rate at which the timer expires can be set to a range of values by the microprocessor 42. The time period which each solenoid valve 31 remains energized is determined by the operation of the solenoid interface circuits 71 and 73, which in turn can be separately configured by writing values to the registers in the PICs 70 and 72. As a result, the rate at which the spray bars 26 are pulsed on is under control of the programs executed by the microprocessor 42, and the duration of the spray pulses from each nozzle 30 of the spray bars 26 can be separately controlled.

Figure 6:
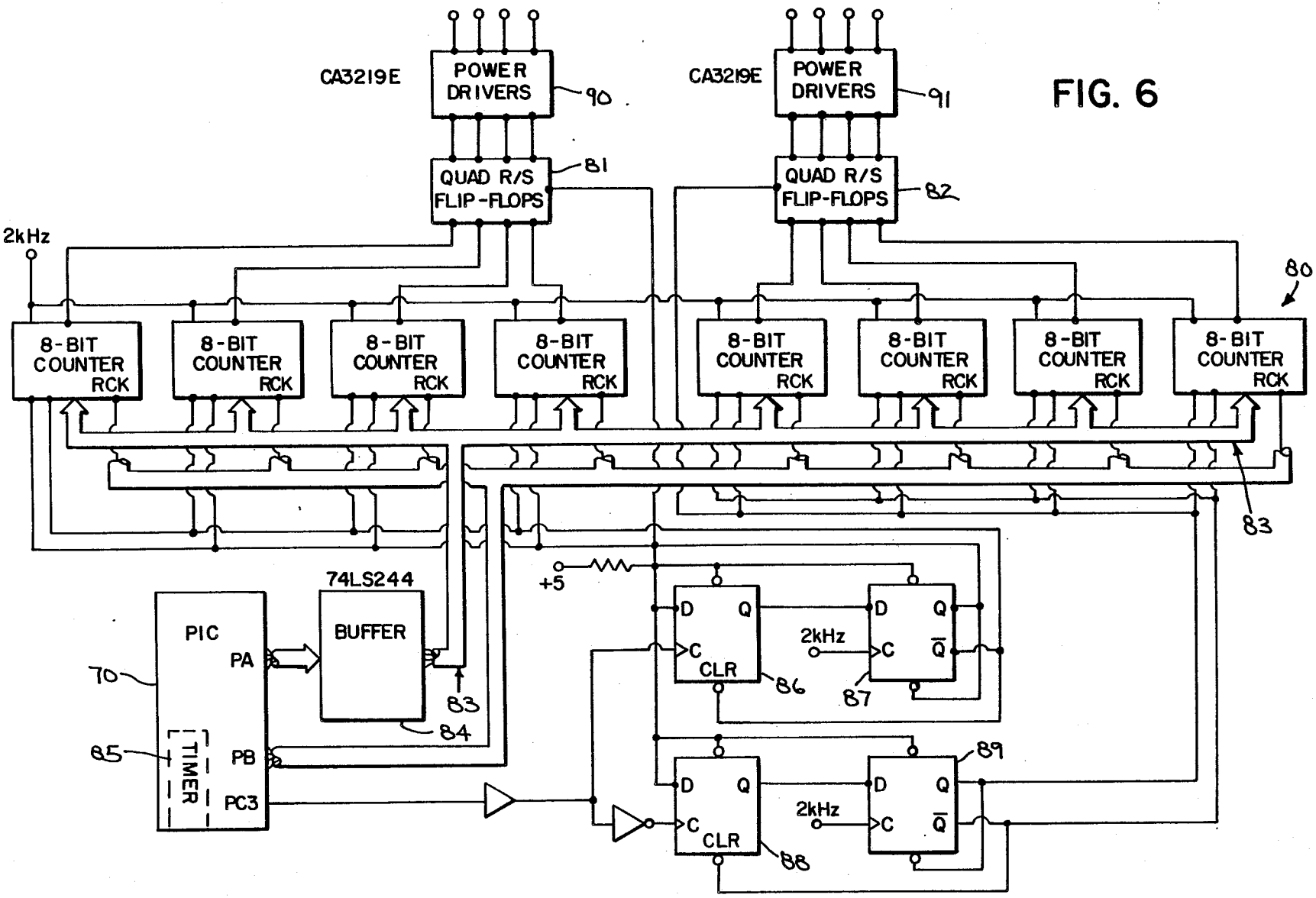
FIG. 6 is an electrical schematic diagram of a solenoid interface circuit which forms part of the drink processor of FIG. 5.

The solenoid interface circuit 71 is shown in FIG. 6. and it should be understood that the solenoid interface circuit 73 is virtually identical. Each includes a set of eight 8-bit binary counters 80 and a set of eight R/S flip-flops 81 and 82. The counters 80 are available in integrated circuit form as the 74LS592 from Texas Instruments, Inc. and they each include an internal 8-bit input register. This input register is loaded with an 8-bit binary number on output bus 83 when a pulse is applied to an RCK input of the counter 80. The RCK inputs of the eight counters 80 are connected to respective ones of the output terminals PB0–PB7 of the PIC 70, and the eight leads in the output bus 83 are driven by the output terminals PA0–PA7 of the PIC 70 through a buffer 84. Thus, any or all of the registers in the counters 80 can be loaded with a binary number on the PA output port of the PIC 70 by enabling the counter's RCK input with a "1" on the corresponding lead of the PB output port. As will be described in more detail below, this circuitry is used to separately preset each 8-bit counter 80 so that the time interval which each of the solenoid valves 30 remains on can be separately controlled.

Referring still to FIG. 6, an output pulse is produced at the PC3 output pin of the PIC 70 each time an internal timer 85 expires. The timer 85 is preset with a calculated current pulse rate value by the microprocessor 42. Each time the timer 85 expires, two phase displaced pulses are produced by a set of four D-type flip-flops 86–89. The Q output of flip-flop 87 sets the RS flip-flops 81 on the leading edge of one pulse and it presets four of the counters 80 with the values stored in their respective input registers. On the trailing edge of this first pulse, the $\overline{Q}$ output of the flip-flop 87 returns to a logic low which enables the same four counters to begin counting. The remaining four counters 80 and the R/S flip-flops 82 are operated in the same manner by the Q and $\overline{Q}$ outputs of the flip-flop 89. The only difference is that the operation of the flip-flop 89 is delayed by one-half the time period between successive pulses from the flip-flop 87.

The eight counters 80 are incremented by 2 kHz clock pulses until they reach the all ones condition. At this point the output of the counter 80 goes to a logic low voltage and it resets the R/S flip-flop 81 or 82 to which it connects. The output of each R/S flip-flop 81 or 82 controls the operation of one of the solenoid valves 31 through power drivers 90 and 91 and, thus, each valve 31 is turned on when the flip-flops 81 and 82 are set, and they are each turned off as their associated counter 80 overflows and resets its R/S flip-flop. The outputs of the drivers 90 are connected to the first, third, fifth and seventh nozzle solenoids and the outputs of the drivers 91 are connected to the second, fourth, sixth and eighth nozzle solenoids. As a result, nozzles 1, 3, 5 and 7 are turned on each time a pulse is produced at PIC output terminal PC3 and nozzles 2, 4, 6 and 8 are turned on a short time interval later (i.e. greater than 5 milliseconds later). Each nozzle 30 is then turned off separately as their corresponding counters 80 overflow. It should be apparent, therefore, that the spray bar solenoids are pulsed on at the same rate, but the duration each is left on, and hence the amount of dampening water delivered to the fountain roller 25, is separately controllable by the value of the 8-bit binary numbers loaded into the respective counter input registers.

Figure 7:
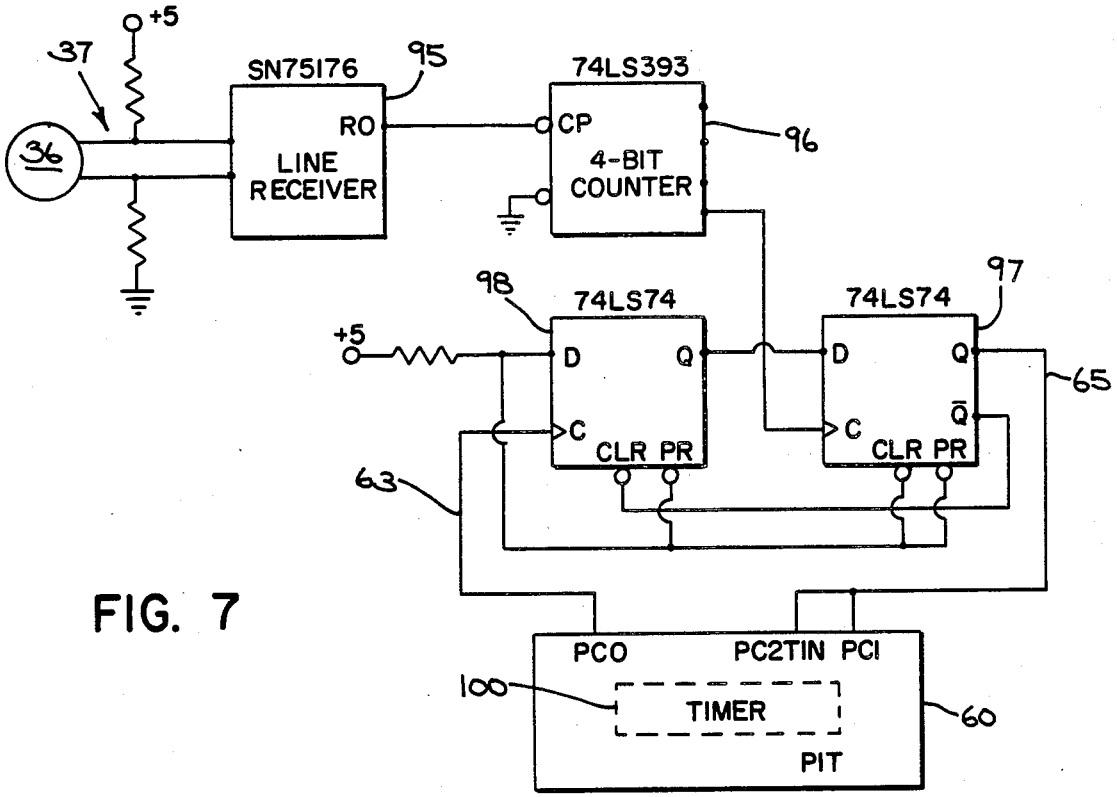
FIG. 7 is an electrical schematic diagram of a speed interface circuit which forms part of the drink processor of FIG. 5.

Referring particularly to FIGS. 5 and 7, the speed interface circuit 64 couples the digital incremented speed feedback signal received from the speed sensor 36 to the PIT 60. The speed sensor 36 produces a logic high voltage pulse for each incremental movement of the web through the printing unit. In the preferred embodiment, a magnetic sensor model 10001 available from Airpax Corporation is employed for this purpose, although any number of position feedback devices will suffice. The speed sensor's signal is applied to a line receiver 95 which produces a clean logic level signal that is applied to the input of a 4-bit binary counter 96. The counter 96 produces an output pulse each time sixteen feedback pulses are produced by the speed sensor 36. This overflow is applied to the clock terminal of a D-type flip-flop 97 which switches to a logic state determined by the logic state applied to its D input. The D input is in turn driven by a second flip-flop 98 which is controlled by the PCO output of the PIT 60 and the $\overline{Q}$ output of flip-flop 97.

When the press speed is to be sampled, a "1" is written to the PCO output of the PIT 60. This transition clocks the flip-flop 98 to set its Q output high and to thereby "arm" the circuit. As a result, when the next overflow of the 4-bit counter 96 occurs, the flip-flop 97 is set and a logic high voltage is applied to the PC2TIN and PC1 inputs of the PIT 60. The $\overline{Q}$ output of flip-flop 97 also goes low to reset flip-flop 98 and to thereby disarm the circuit. As long as input PC2TIN is high, an internal timer 100 in the PIT 60 is operable to measure the time interval. The input PC1 may be read by the microprocessor 42 to determine when a complete sample has been acquired. After sixteen feedback pulses have been received, the counter 96 again overflows to reset the flip-flop 97 and to thereby stop the timer 100 in the PIT 60. Input PC1 also goes low, and when read next by the microprocessor 42, it signals that a complete sample has been acquired and can be read from the PIT 60. The entire cycle may then be repeated by again writing a "1" to the PCO output of the PIT 60.

While many means are available for inputting an indication of press speed, the speed feedback circuit of the present inventions offers a number of advantages. First, the effects of electronic noise on the measured speed are reduced by the use of the counter 96. The error caused by a noise voltage spike on the input lines is effectively reduced to about one sixteenth the error that would result if speed were measured by sensing the feedback pulse rate directly. In addition, by using the timer in the PIT 60 to record the time interval and save the result, the microprocessor 42 is not burdened with a continuous monitoring of the speed feedback signal. Instead, when the system requires an updated sample of press speed, the microprocessor checks the PIT 60 and reads the latest value stored therein. It then initiates the taking of another sample and continues on with its many other tasks.

DESCRIPTION OF THE DATA STRUCTURES

Figure 8:
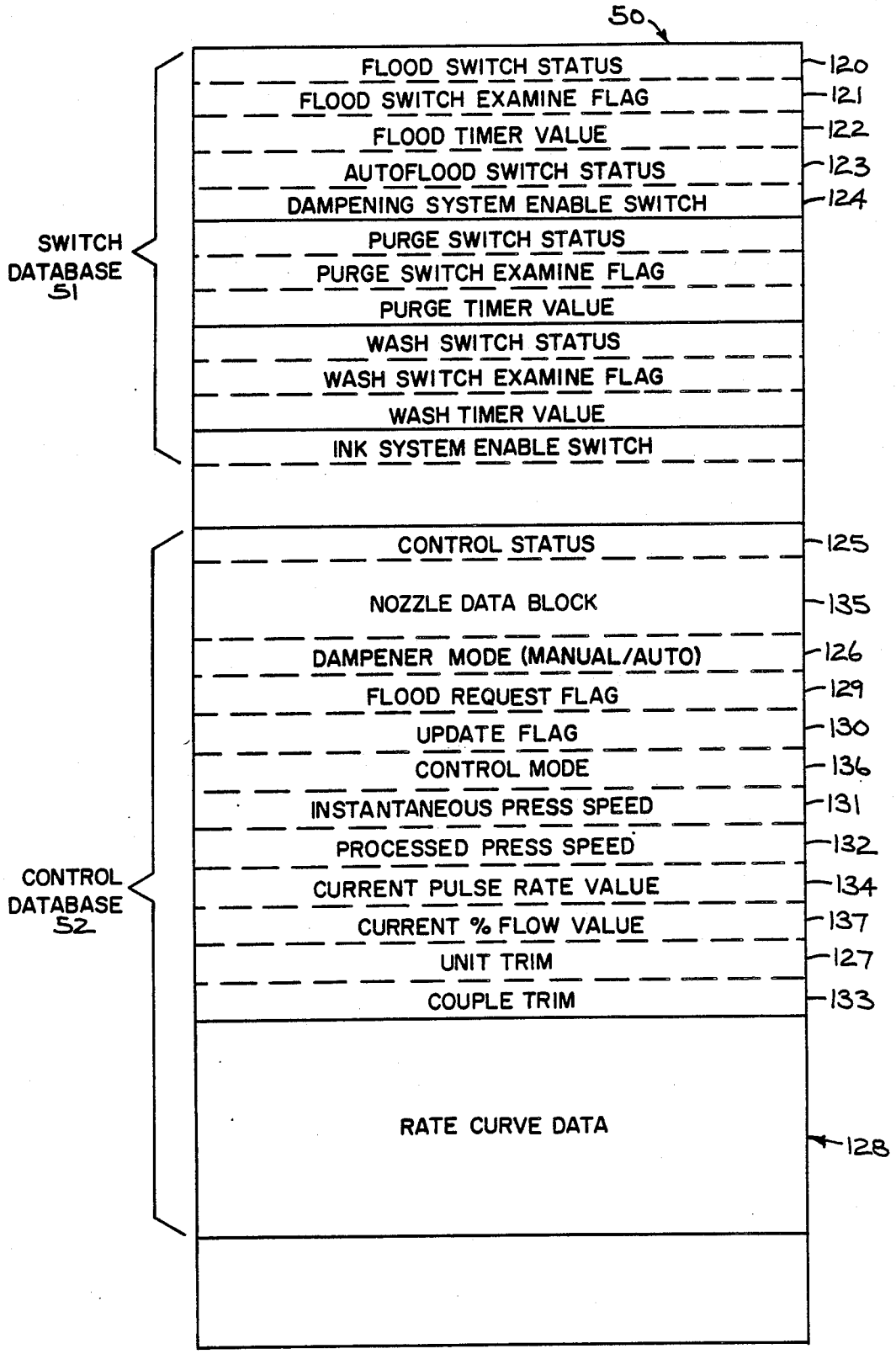
FIG. 8 is a schematic representation of important data structures which are stored in the RAM of FIG. 5.

Referring to FIG. 8, the data structures which are employed by the preferred embodiment of the present invention to control the spraybars 26 are stored in the RAM 50. As indicated above, these data structures are collectively referred to as the switch database 51 and the control database 52. The structure of these two databases 51 and 52 are illustrated in FIG. 8 for one printing couple. Similar data is stored in the databases 51 and 53 for the other printing couple in the unit 10.

The switch database 51 includes an image of the switch states on the local control panel 53 (FIG. 5). The operator depresses a "FLOOD" switch when extra dampening water is to be applied during startup. As will be described below, when this occurs, the dampening water flow rate is increase 25% for a preset time interval. To support these functions, a flood switch status word 120, a flood switch examine flag 121 and a flood timer value 122 are stored in the RAM 50. Flood switch status 120 is updated every 100 milliseconds as will be described below to reflect the current state of the control panel switch. The other two data structures are employed to recognize the flood request and implement the request for a preset time interval.

When an autoflood signal is received from the press monitor and control 38 during automatic sequencing at the beginning of a press run, dampening water is also increased. The status of this signal is stored at an autoflood switch status word 123, and as long as it is present, increased dampening water will be produced. And finally, the dampening system can be disabled by the operator and this event is stored at 124.

A number of other data structures are contained in the switch database 51, but these pertain to the inkrate control system for the printing unit 10, and these will not be discussed in any detail in this specification.

The data structures in the control database 52 which are required by the dampening system are illustrated in FIG. 8. These include a control status 125 which indicates if the control is in the process of making a requested change ("change in progress") or if no changes have been requested ("idle"). Control status 125 also includes a "changes not complete counter" which indicates at any time the number of controllable nozzles which are undergoing changes. A dampener mode word 126 indicates if the dampening system is in either manual or automatic mode. In the manual mode the dampening flow rate is set to a value indicated as unit trim 127, which can be manually altered from the master work station 11 or a local panel 53 (FIG. 1). In the automatic mode, the dampening water flow rate is calculated as a function of press speed in accordance with stored rate curve data 128 as will be described in more detail below.

A flood request flag 129 is set when the flood function is being performed and an update flag 130 is set when a significant change in press speed has occurred or new rate curve data 128 has been down loaded from the master work station 11. As will be explained in detail below, the press speed is measured every 100 milliseconds and stored as the instantaneous press speed 131. If the instantaneous press speed 131 differs by more than ±0.5% from a processed press speed stored at 132, then the processed press speed 132 is updated with the newly measured value and the update flag 130 is set. The processed press speed 132 is used in combination with the rate curve data 128 to calculate a new dampening water flow rate when the dampening system is in the "AUTO" mode. This is converted to a pulse rate and is modified by a stored couple trim value 133 and increased further if the flood request flag 130 is set. The resulting current pulse rate value is stored at 134 and is output to the timer 85 in the PIC 70 (FIG. 6). The couple trim value 133 may be changed from the local control panel 53 to provide a means for manually adjusting the dampening water flow rate while in the AUTO mode. A current % flow value stored at 137 is a number which may be read out and displayed. It expresses the current pulse rate value 134 as a percentage of the maximum pulse rate value and, hence, it indicates the percentage of maximum dampening water flow rate which is currently being applied.

Not only is the pulse rate applied to the spraybar nozzles 30 controlled, but also, the width of each pulse is separately controlled. This function is supported by a nozzle data block 135. The data block 135 stores information on each of the eight controllable nozzles 30 which will be described in more detail below with respect to FIG. 9C.

Figure 9A:
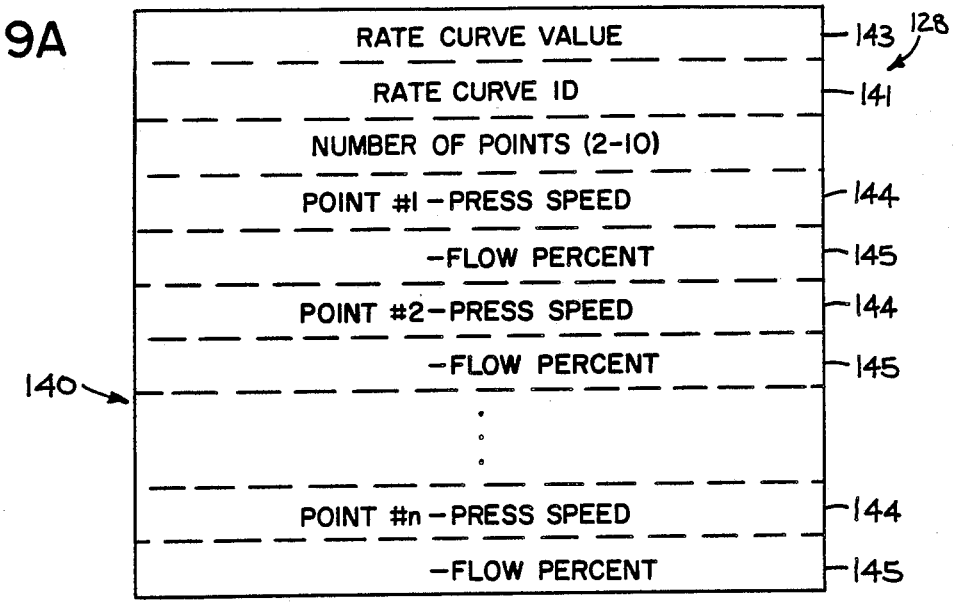
FIGS. 9A–9C are schematic representations of specific data structures which are shown as blocks in FIG. 8.
Figure 9B:
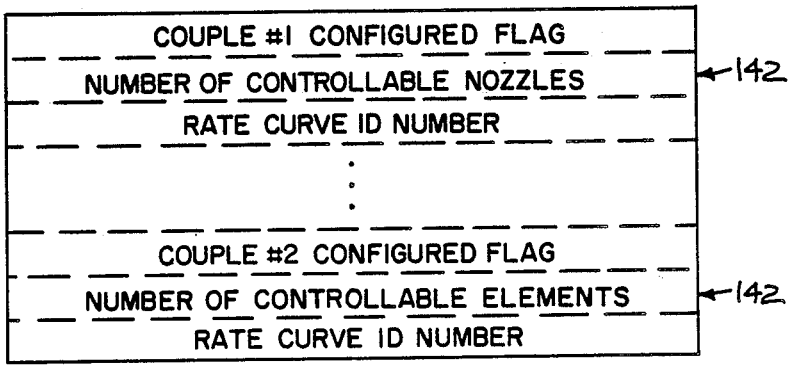

The rate curve data 128 is illustrated in detail in FIG. 9A. It may include one or more rate curve data blocks 140 that may be used with one or both printing couples. Each data block 140 includes a rate curve ID 141 which uniquely identifies it. Each printing couple is associated with a particular rate curve data block by this rate curve ID number. As illustrated in FIG. 9B, a configuration database stored in the RAM 50 includes configuration records 142 for each printing couple. These configuration records 142 include a rate curve ID number which link each printing couple to one of the stored rate curve data blocks 140. These configuration records 142 can be altered by messages from the master work station 11 and, hence, the rate curve data block 140 associated with a particular printing couple can be altered at any time.

Each rate curve data block 140 also stores a rate curve value 143 which indicates the current dampening water flow rate as calculated from the data in this rate curve data block 140 and the processed press speed 132. A third entry in the block 140 is the number of rate curve points which are stored in this data block 140 and the remainder of the data block 140 is comprised of the data which defines each of these points. Each point is defined by a press speed number 144 and a flow percent number 145. Anywhere from two to ten points may be stored which indicate the desired dampening water flow rates across a range of press speeds. As will be described in more detail below, the rate curve value 143 is calculated by linearly interpolating between the flow percent numbers 145 for the points which have press speed numbers 144 to each side of the processed press speed 131.

Figure 9C:
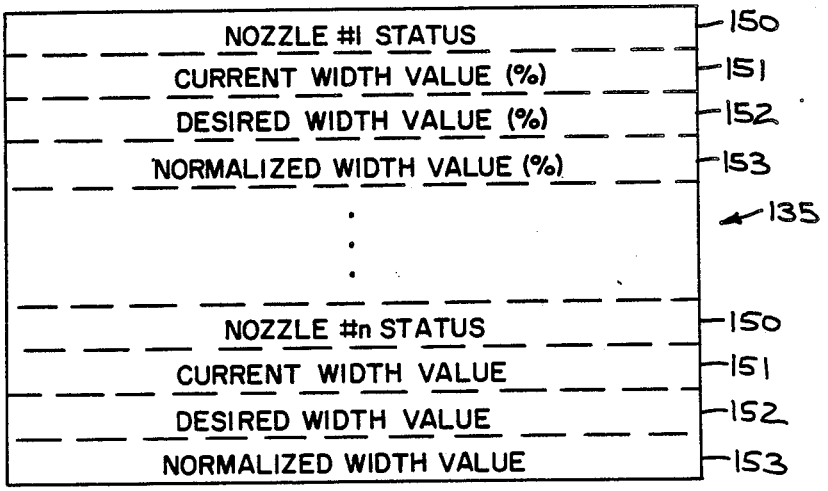

Referring particularly to FIGS. 9B and 9C, each printing couple may have up to eight separately controllable nozzles 30 on its spraybar 26. The number is indicated in the configuration record 142 for each couple. The nozzle data block 135 in the control database 52 stores data on each controllable nozzle 30. More specifically, the status 150 of each nozzle is stored (idle/change requested/change in progress). Also, stored in this block 135 is the current pulse width value 151 which indicates the value actually being output to the PIC 70 or 72 (FIG. 5), the desired pulse width value 152 which indicates the pulse width which has been commanded, and the normalized pulse width value 153 which indicates the current value unmodified by any flood request or the like. The nozzle data block 135 is employed to control each nozzle 30 and to implement a change in the pulse width produced by each nozzle 30 in response to messages received over the serial link 31 from the communications processor 30 (FIG. 4).

DESCRIPTION OF THE SOFTWARE

As indicated above with respect to FIG. 5, the programs which direct the operation of the microprocessor 42 and, hence, control the operation of the drink processor 35 are stored in the ROM 44. As shown diagrammatically in FIG. 10, these programs include a set of programs which carry out specific tasks or processes as well as a real time clock interrupt service routine and an operating system program. The operating system program is indicated by block 200 and it is a commercially available program for the model 68000 microprocessor. It is responsible for the orderly allocation of processor time to each of the other programs. In the preferred embodiment, the operating system 200 is a real-time, multi-processing operating system kernel commercially available from Software Components Group, Inc. under the trademark "pSOS-68K". The operating system 200 acts as a nucleus of supervisory software which performs services on demand, schedules the running of other programs, manages and allocates resources, and generally coordinates multiple, a synchronous real-time activities.

Most of the programs are processes which carry out specific tasks. These processes can be in any one of three states: running; ready; or blocked. A ready process is one which can be run. Since only one ready process can be running at a given time on the microprocessor 42, the others must wait their turn. A ready process is allowed to run when its priority is higher than all the other ready processes. A running process is one that is being executed even if it is momentarily interrupted by a real time clock interrupt routine 201 or it makes calls to I/O service routines. A process becomes blocked as a result of a deliberate action on the part of the process itself which causes it to wait. For example, a process is blocked if it requests a message from an empty message queue, requests memory which is not presently available, waits for an event which is presently not pending, or pauses for a specified time interval. A blocked process becomes ready when a blocking condition disappears or is removed.

As indicated above, the ready process having the highest priority is allowed to run. When a process enters the ready state, the operating system 200 places it in a ready list which is stored in the RAM 50 at a location which reflects its priority relative to the other processes on the ready list. The operating system will normally run the process at the top of this ready list when it returns to the application programs.

Figure 10:
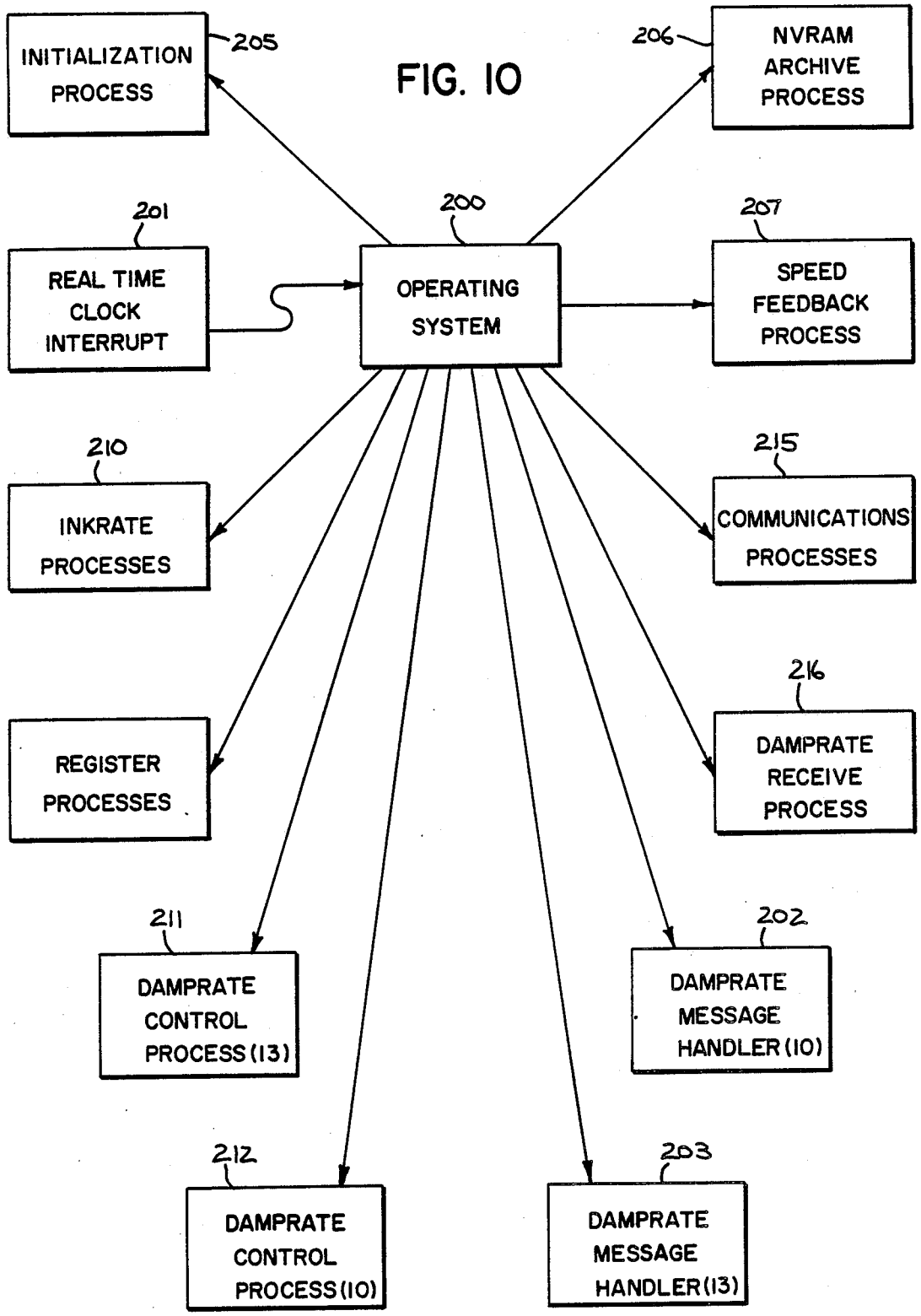
FIG. 10 is a block diagram which illustrates the various software modules that are used to control the drink processor of FIG. 5.

Referring still to FIG. 10, during power-up an initialization process 205 is ready to run and is executed first. The initialization process creates, or spawns, the other processes for the operating system 200 and it establishes the data structures described above. In addition, a number of diagnostic functions, such as memory checks and hardware checks are performed, and the programmable interface timer (PIT) 60 and programmable interface controllers (PIC) 70 and 72 are configured to operate as described above. And finally, the various system processes are activated so that upon return to the operating system 200, it will begin to run the highest priority process which is in the ready state.

One of these processes is the NVRAM archive process 206 which is executed each time it is signaled by another process that a change has been made in data which is achieved. This program transfers data in the control database 52 to a nonvolatile memory (not shown in the drawings) where it is available for use when restarting after loss of power. After transferring the data, the process 206 blocks itself and returns to the operating system 200.

The real time clock interrupt routine 201 is executed every 25 milliseconds in response to an interrupt from a real time clock. The real time clock is formed by a counter in the DUART 55 (FIG. 5) which produces an interrupt request signal for the microprocessor 42 on a line 66 every 25 milliseconds. In response, the microprocessor 42 is vectored to the interrupt service routine 201 which records the passage of one or more increments of time. In addition, the service routine 201 decrements the time other processes have remaining before being reawakened. If, as a result, the wait time for any blocked process is decremented to zero, that process is unblocked and placed in the ready state by the real time clock interrupt. Thus, any process in the system may block its own execution for a selected time interval and the interrupt service routine 201 will unblock it after that time interval has expired.

Referring still to FIG. 10, a speed feedback process 207 is executed each time a real time clock interrupt is received and processed by the interrupt routine 201. In addition to reading the current speed from the PIT 60 every 100 milliseconds and initiating the taking of another speed sample, this routine reads the switches on the control panel 53 every 100 milliseconds through the PIT 60. The instantaneous press speed value 131 is stored in the control database 52 and if the press speed has changed by $\pm 0.5\%$, an event is signaled to a number of processes, including inkrate processes indicated collectively at block 210 and damprate control processes 211 and 212. The switch states are stored in the switch database 51, and if a change has occurred, an event is signaled to one of the damprate message handlers 202 or 203, or one of the inkrate processes 210. The speed feedback process 207 will be further described below with respect to FIG. 11.

Figure 16:
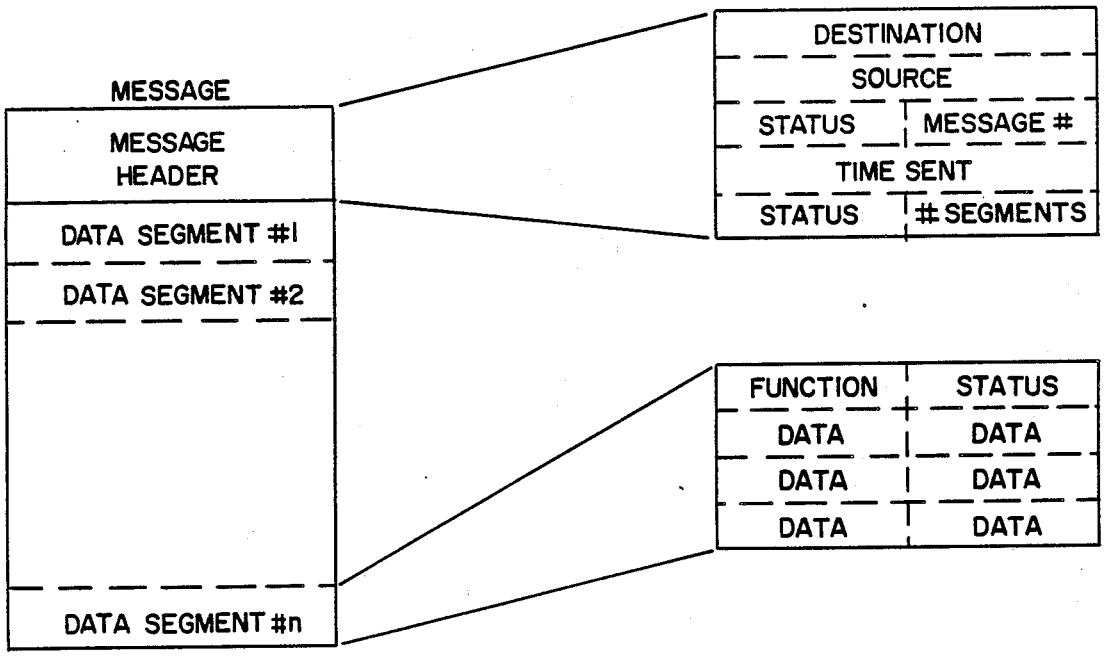
FIG. 16 is a diagram of the message format used in the unit controller of FIG. 4.

Referring to FIGS. 4 and 10, communications through the serial channel 31 with the communications processor 30 is handled by send and receive processes which are indicated collectively by the block 215 entitled "communications processes". The format of the messages is illustrated in FIG. 16, where the "source" field identifies the origin of the message. The receive process inputs message data which is received through the DUART 55. When a message has been received, it checks the "destination" field of the message to determine if it is directed to the inkrate, register or damprate control on this drink processor 35. If not, an error reply message is created and passed to the send process for transmission back to the processor 30 through the serial link 31. Proper messages are stored in the receive message buffer 49 and the message is posted to the appropriate inkrate receive process, register receive process or damprate receive process 216.

The send process creates outgoing messages and transmits them through the DUART 55 and serial link 31 to the communications processor 30. Message data is read from the send message buffers 66 and assembled into a message which conforms to the serial link protocol. After sending the message, the send process suspends itself and remains suspended until another process places a message in the send message buffer 66 and signals the send processor of the event.

Referring to FIG. 10, the damprate receive process 216 handles all messages in the receive message buffer 49 which are intended for damprate control. It validates the message and then processes it in accordance with the data segment "function" field (FIG. 16). Messages which change the damprate control values are passed to the damprate message handler 202 which is then activated by the damprate receive process 216. On the other hand, when a dampening rate curve specification message providing new curve points is received, the damprate receive process 216 updates the rate curve data 128 in the control database 52 directly. When a rate curve mode change is received, the message is passed to the message handler 202.

Read request messages which seek current pulse width value 151, rate curve data 128 or mode information 126 are handled directly by the damprate receive process 216. The requested information is read from the control database 52 and placed in the send message buffer 66. The process 216 then activates the communication process (send) 215. When all incoming messages have been processed, the damprate receive process 216 becomes blocked until a new message is placed in the receive message buffer for it.

Each damprate message handler 202 and 203 coordinates the flow of data incoming from both the speed feedback process 207 and the damprate receive process 216 for one printing couple (side 10 or side 13). Each is responsible for directing the corresponding damprate control process 211 or 212 to carry out the indicated function or change. It is also responsible for responses back from the damprate control process 211 or 212 that a function has been executed or that a change has been completed, and for formulating a corresponding responsive message. Responsive messages which indicate that a function has been performed or that a change in operating conditions has been completed are placed in the send message buffer 66 and the communications process (send) 215 is activated. The operation of the damprate message handler 202 and 203 will be described in more detail below with respect to FIG. 12.

Referring still to FIG. 10, the damprate control processes 211 and 212 determine the rate at which the spraybar nozzles 30 are to be turned on and off. There is a damprate control process for each printing couple in the unit 10. These processes 211 and 212 also separately control the duration of time that each spraybar nozzle 30 remains on so that the spray pattern can be precisely trimmed over the entire width of the plate cylinder 21. As will be described in more detail below, when in the automatic mode the damprate control process 211 or 212 calculates the dampening flow rate based on the current press speed and the stored rate curve data. This calculation is performed each time the speed feedback process 207 indicates that press speed has changed by setting the update flag 130 in the control database 52. When in the manual mode, the dampening flow rate is set by the unit trim value 127 stored in the control database 52. This value as well as others can be manually changed by sending change messages which are passed to the damprate control process 211 or 212 by its associated damprate message handler 203 or 202. After the change has been implemented, the damprate control 211 or 212 signals this event to its message handler 203 or 202 which initiates a responsive message as described above. The damprate control process will be described in more detail below with reference to FIG. 13.

Figure 11:
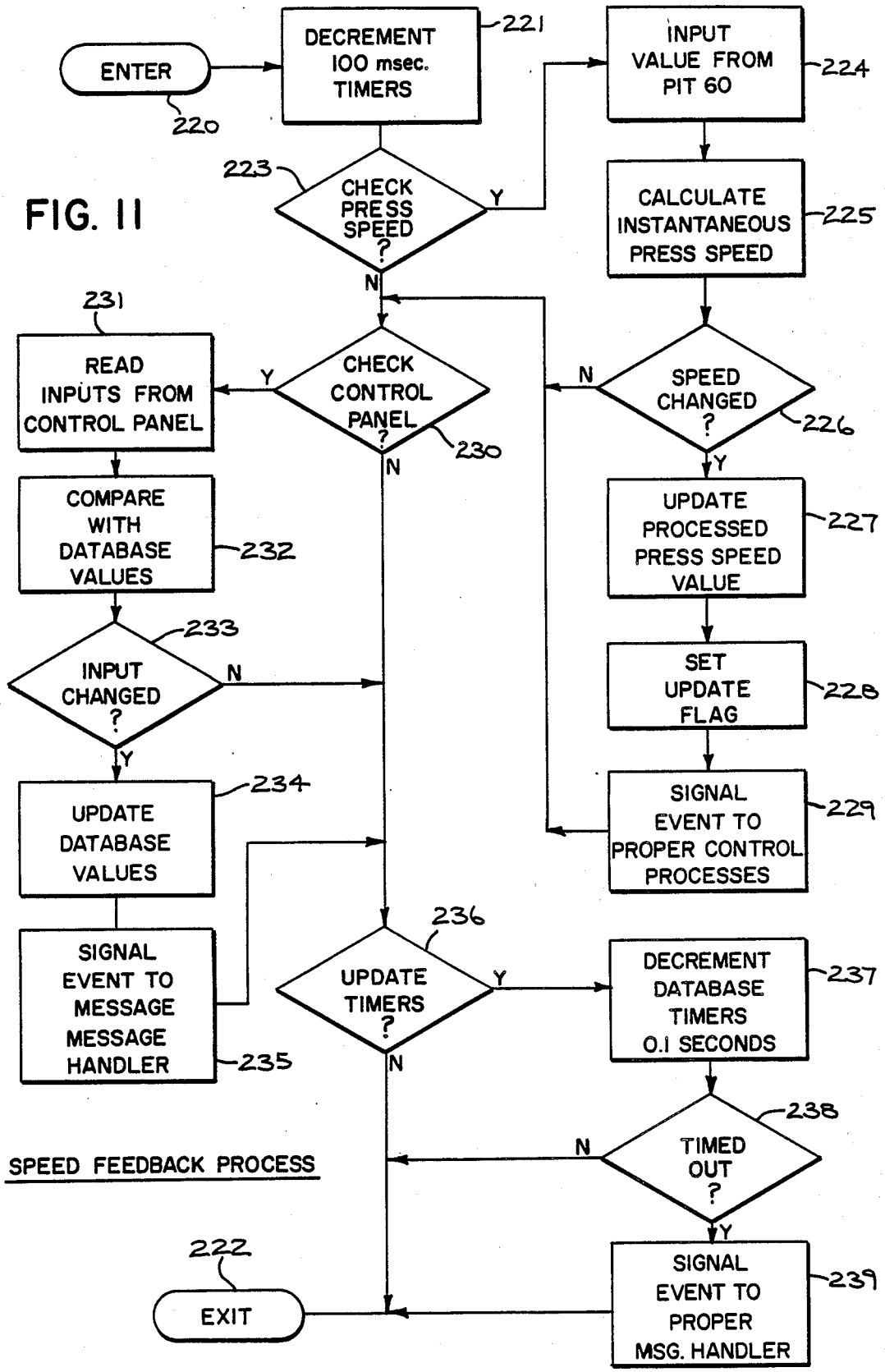
FIG. 11 is a flow chart of the speed feedback process which forms one of the modules of FIG. 10.

Referring particular to FIGS. 8 and 11, the speed feedback process 207 is unblocked every 25 milliseconds by the real time clock interrupt 201. When run, this process enters at 220 and decrements three 100 msec. timers as indicated by process block 221. One of these timers measures the interval between updates to press speed, another measures the interval between control panel scans, and the third measures 100 msec. "tics" on a variety of software timers. If none of these timers is decremented to zero, the process blocks itself for another 25 milliseconds and exits at 222 back to the operating system 200.

Every 100 milliseconds the press speed is checked. The process branches at decision block 223 when the appropriate timer expires and the value of the timer 100 in the PIT 60 (FIG. 7) is read into the microprocessor 42 as indicated at process block 224. A new press speed sampling cycle is also initiating by writing a "1" to the PCO output of the PIT 60. Using the timer value, the instantaneous press speed is calculated at process block 225 by dividing the timer value into a constant which represents the distance moved by the press to produce sixteen incremental feedback pulses. The value is stored as the instantaneous press speed 131. A check is then made at decision block 226 to determine if the press speed has changed enough to warrant an update of the processed press speed. This is accomplished by determining if the absolute difference between instantaneous press speed and processed press speed is greater than 0.5% of one hundred percent press speed. If not, the process branches back, otherwise, the processed press speed value 132 is updated with the instantaneous press speed value 131 as indicated at 227. In addition, the update flag 130 is set as indicated at block 228 and the effected control processes are signaled of the event as indicated at process block 229.

Referring still to FIGS. 8 and 11, if the control panel timer has expired as determined at decision block 230, feedback process 207 reads the inputs from the control panel 53 as indicated at 231. This is accomplished be reading the 8-bit PB port on the PIT 60 (FIG. 5). The individual switch status bits are then masked out and compared at block 232 with the corresponding switch status bits in the switch database 51. If none of the switches have changed, the process branches at decision block 233. Otherwise, the changed switch status is updated in the switch database 51 at block 234 and the switch change event is signaled at block 235 to the proper damprate message handler process 202 or 203 or inkrate message handler 210.

And finally, if a 0.1 second tic has occurred, the feedback process 207 branches at decision block 236 to decrement the database timer values which are maintained for FLOOD, PURGE and WASH, as indicated at process block 237. If any such timer is reduced to zero, as determined at decision block 238, the appropriate message handler process is signaled at 239 that an event has occurred. For example, if the flood timer value 122 is decremented to zero, this event is signaled to the damprate message handler 202 or 203 for that printing couple. The functions performed by the speed feedback process 207 are then complete and the system exits at 222 back to the operating system 200.

A source code listing of the speed fedback process 207 is provided in Appendix A.

The damprate message handler 202 or 203 runs only when it is signaled by the speed feedback process 207 that a switch has changed state, or when it is signaled by the damprate receive process 216 that a change request, set request or flood request message has been received, or when the damprate control process 211 or 212 signals that a previous request has been completed.

Figure 12A:
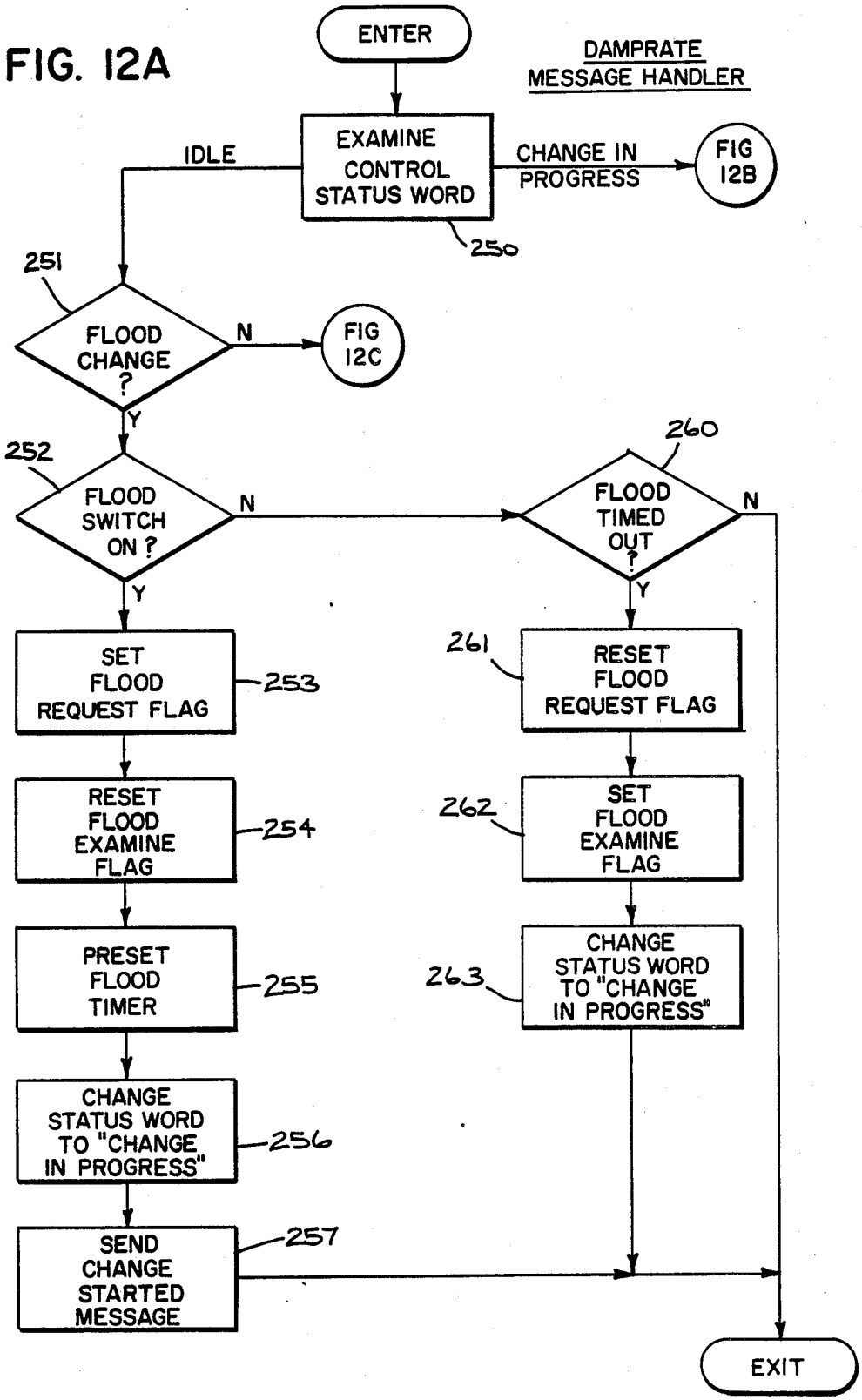
FIGS. 12A–12C are a flow chart of the damprate message handler which forms two of the modules of FIG. 10.

Referring to FIG. 12A, when the damprate message handler 202 or 203 runs it examines the control status word 125 in the control database 52 as indicated by process block 250. If the control is in the process of making a change, the system branches as indicated to FIG. 12B. On the other hand, if the control is idle, then requested changes made to the message handler can be started. One type of change which can be requested is for a flood start from the local control panel 53 or a flood stop from the damprate control process 211 or 212. This is detected at decision block 251 which examines requests that are made to the damprate message handler. As indicated at decision block 252, the flood switch status 120 in the switch database 51 is then examined to determine if it is on. If so, flood request flag 129 is set at block 253 to signal the damprate control process, and the flood examine flag 121 is reset at 254 so that the recognition of the state change in the flood switch is recognized only once. The flood timer 122 is then preset to a fixed value of 2 seconds at process block 255, and control status 125 is altered at block 256 to indicate "change in progress". A "start" message is then passed to the communications process 215 at block 257 for sending to the master work station 11. The start message indicates that the flood operation has started.

Referring still to FIG. 12A, if the flood switch is off, as determined at decision block 252, then the flood timer value 122 is checked at decision block 260. As indicated above, this timer is decremented every 100 milliseconds by the speed feedback process 207 and when it reaches zero, the flood request flag 129 is reset at block 261 to signal the damprate control process that the flood operation is to terminate. The flood examine flag 121 is then set at block 262 so that a closure of the flood switch will be recognized as a new flood request, and the control status 125 is set at 263 to indicate "change in progress".

Figure 12B:
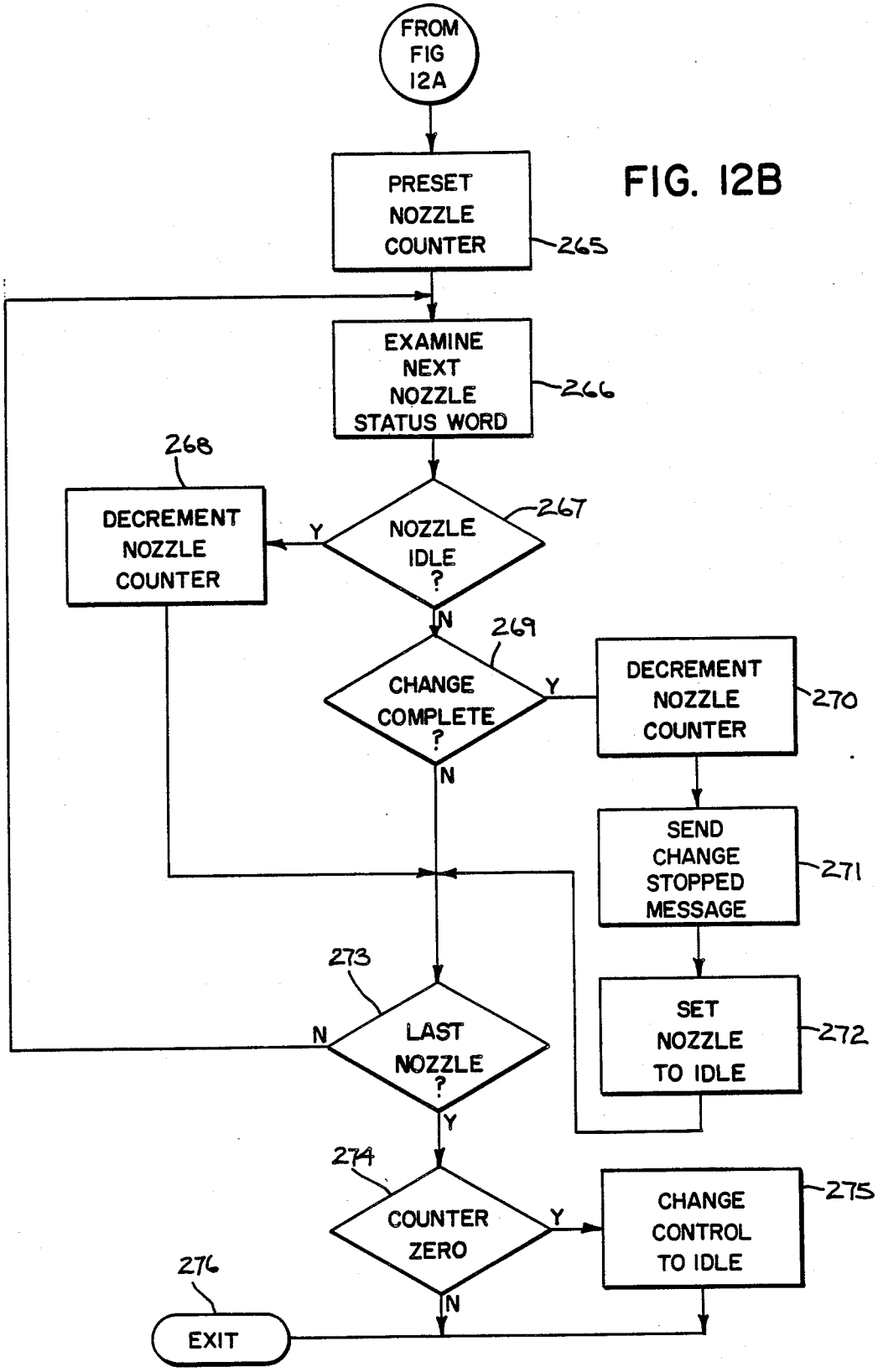

Referring to FIG. 12A, if the control status 125 is set to "change in progress" when the damprate message handler is run, the process branches at block 250 to FIG. 12B. A counter is then preset to the number of nozzles in the printing unit at block 265 and a loop is entered in which the nozzle status 150 (FIG. 9C) in each nozzle data record is examined. The nozzle status word 150 is read at block 266 and if it is set to "IDLE", the process branches at decision block 267 to decrement the nozzle counter at process block 268. On the other hand, if the nozzle status word 150 is set to "change complete" as determined at decision block 269, the process branches to decrement the nozzle counter at 270. A "STOP" message is then passed to the communications process 215 as indicated at block 271 and the nozzle status word 150 is set to "IDLE" at process block 272. The STOP message is conveyed through the serial channel 31 to the communications processor 30 to indicate that a change in nozzle pulse width has been completed.

After all the nozzle status words have been examined as determined at decision block 273, the nozzle counter will indicate the number of nozzles still in the "change in progress" state. If none are in this state as determined at decision block 274, the control status word 125 is changed to "IDLE" at process block 275 and the process exits at 276.

Figure 12C:
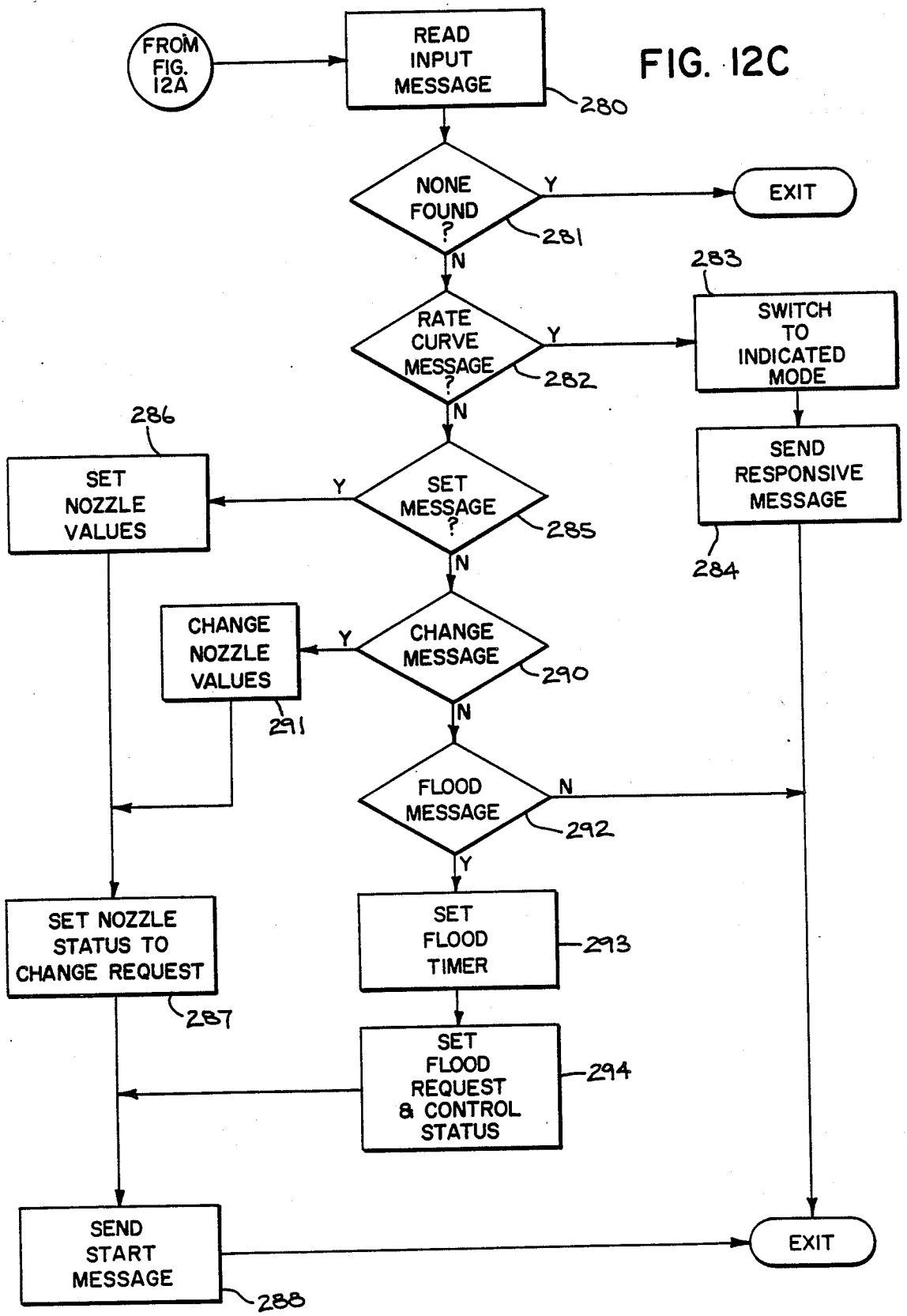

Referring again to FIG. 12A, if the control status is IDLE and no change in flood status is detected at decision block 251, the process branches to FIG. 12C to read at block 280 any messages which have been passed to it by the damprate receive process 216. If none are found, the process branches at decision block 281 and exits back to the operating system 200. Otherwise, the "function" field in the received message is analyzed to determine its type. If the received message contains rate curve mode set data, the process branches at decision block 282. The "mode" field in this message indicates if the control is to operate in the automatic or manual mode. As indicated at process block 283, if the indicated mode differs from that stored in the control mode word 136 of the control database 52, a mode switch is initiated. This includes changing the control mode word 136 to the new mode. A responsive message is then passed back to the communications process 215 at process block 284 to acknowledge that the message was received and acted upon.

If the received message indicates that the pulse width values of the nozzles 30 are to be set to new values, the process branches at decision block 285. The new pulse width values are extracted from the message at process block 286 and written into the desire width value word 152 of the associated nozzle data record. The nozzle status word 150 is then set to "change request" and the control status word 125 is set to "change in progress" at block 287. A START message is passed to the communications process 215 at block 288 to indicate that changes are being made to the nozzle pulse width in accordance with the SET message.

If a "CHANGE" message is received, as indicated at decision block 290, the increment of change for each nozzle 30 is extracted from the received message and is added to the nozzle's desired width value 152 in the control database 52. This is performed by a set of instructions represented by process block 291. The nozzle status 150 is then set to "change request" at block 287 and a "START" message is sent at process block 288 to indicate that the requested change is being made.

Referring still to FIG. 12C, if a flood request message is received, as determined at decision block 292, the time value is extracted from the message and written to the flood timer value 122 in the switch database 51 at process block 293. The flood request flag 129 in the control database 52 is then set at process block 294 to initiate the flood operation and control status 125 is set to change requested. A "START"message is then sent at process block 288 to indicate that the flood operation has commenced.

Figure 13:
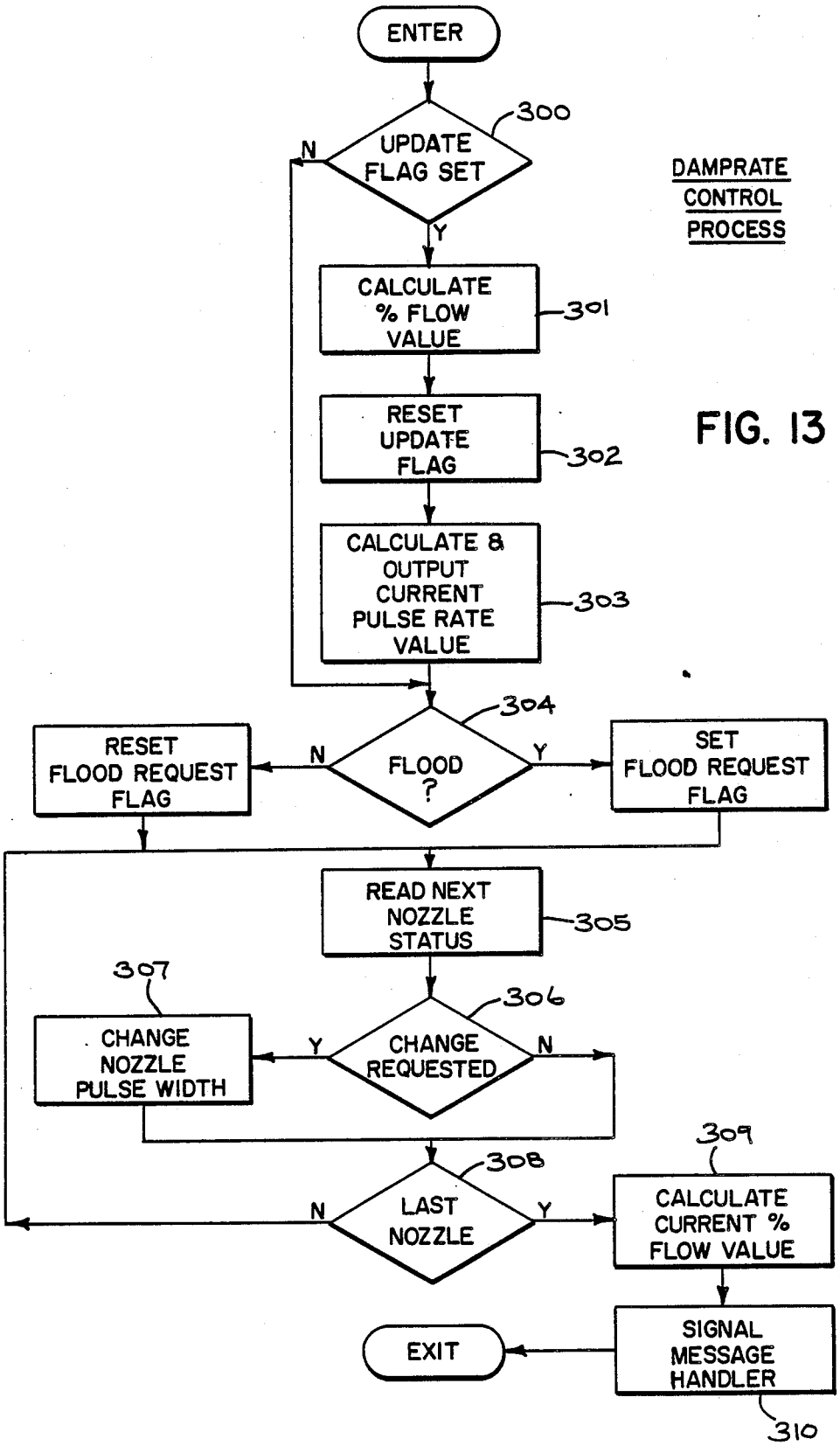
FIG. 13 is a flow chart of the damprate control process which forms two of the modules of FIG. 10.

Referring to FIGS. 8 and 13, the damprate control processes 211 and 212 are run when an event is signaled by the speed feedback process 207 or the associated damprate message handler 202 or 203. As indicated above, the speed feedback process periodically updates the processed press speed 132 in the control database 52 and signals the damprate control process of this event. Similarly, when a flood request switch closure occurs, or when a message is received which changes the rate curve data or requests a flood or change in the nozzle pulse widths, the damprate message handler signals the damprate control process of this event. The damprate control process operates the elements of the control system to carry out a change in either pulse rate or pulse width.

When the damprate control process is run, a check is made first to determine if the update flag 130 has been set. If so, the rate curve data 128 has been changed, or the press speed has changed, and the process branches at decision block 300 to recalculate a new pulse rate. As will be described in more detail below, this recalculation includes calculating a new flow rate percentage using the processed press speed 132 and rate curve data 128 as indicated at process block 301. This number indicates the percentage of maximum dampening water flow rate required at the current press speed. The update flag 130 is then reset at process block 302 and the current pulse rate value is then calculated at process block 303 as follows:

Current Pulse Rate Value=Minimum Pulse Rate+% Flow Value *((Maximum Pulse Rate−Minimum Pulse Rate/100))

If the system is in the manual mode the unit trim value 127 is used a the % flow value in this calculation, whereas the value returned as a result of the calculation in process block 301 is used as the % flow value when in the automatic mode. The calculated current pulse rate value is converted to a value for the PIC timer 85 by the following expression:

Timer Value=Unit Trim Value(%)×Maximum Timer Count Value/100

Where: Maximum Timer Count Value=100

If the current pulse rate value has changed, the newly calculated value is output to the timers 85 in the PICs 70 and 72 (FIG. 6). As indicated above, these timers are continuously decremented and each time they reach zero, a pulse is output which causes each nozzle 30 on the spraybars 26 to be turned on.

Referring still to FIG. 13, the existence of a flood request is checked next at decision block 304. This is accomplished by examining the state of the flood request flag 29, the flood switch status 120, the flood switch examine flag 21, and the flood time value 122. The flood request flag 129 is either set or reset depending on the outcome of these examinations. A loop is then entered at process block 305 in which the status of each nozzle in the spraybar is examined. If the nozzle status 150 (FIG. 9C) indicates "change requested", then the process branches at decision block 306 to calculate a new pulse width value for the nozzle and output it to the PIC 70 or 72 as indicated at process block 307. As will be described in more detail below, the nozzle pulse width is set to the desired width value 152 plus a 25% flood increment if the flood request flag 129 is set. This pulse width number is saved as the current width value 151 and it is output to the PIC 70 or 72 along with a bit pattern that identifies the particular nozzle being set. The pulse width value is, therefore, loaded into the appropriate 8-bit counter 80 (FIG. 6) as described above.

When the last nozzle has been examined and updated as determined at decision block 308, the current percentage flow value 137 is calculated at process block 309. This value represents the percentage of flow which would be required in manual mode to provide the same average flow as that currently being provided. It is a number which pressmen relate to and is commonly read out to the master control station 11 with a read message to provide an indication of dampening rate. And finally, the message handler is signaled at block 310 that an event has occurred which requires its attention and the process exits back to the operating system 200.

Figure 14:
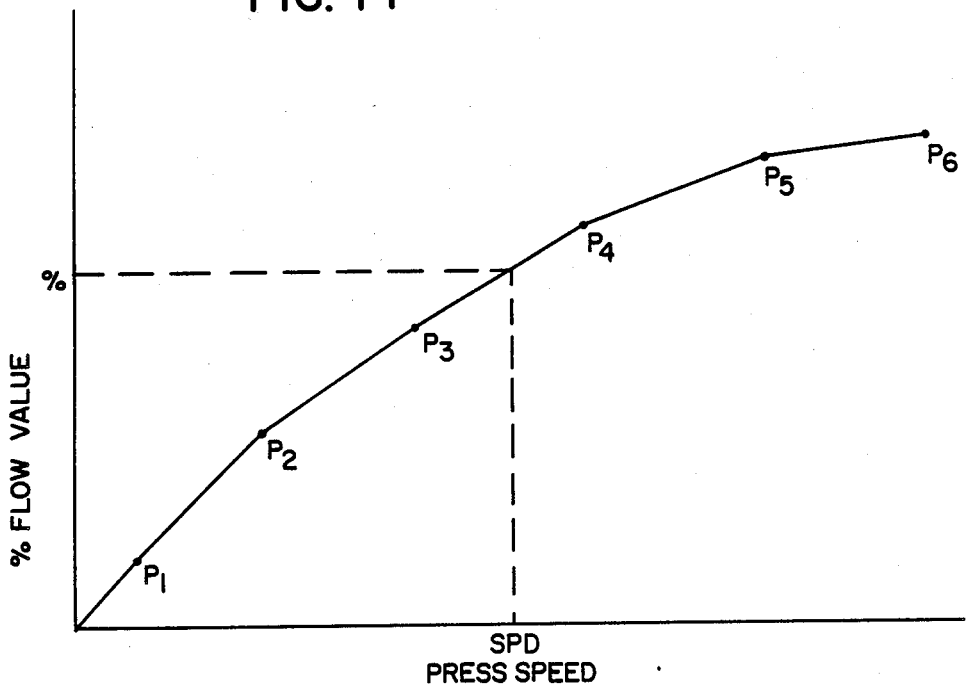
FIG. 14 is a graphic representation of a damprate curve defined by damprate curve data stored in the drink processor of FIG. 5.

As indicated above, when the dampener system is in automatic mode, the % flow value is calculated from the processed press speed 132 and the applicable rate curve data 128. Referring to FIG. 14, a representative dampening rate curve is shown which is defined by six points $P_1$–$P_6$ in a rate curve data block 140 (FIG. 9A). Each point is defined by a press speed and a flow percent value. Since a linear interpolating process is used in the preferred embodiment to calculate the % flow value for any given press speed, the curve is constructed with straight line segments between each point $P_1$–$P_6$.

To calculate the % flow value, therefore, the two points on the curve which straddle the processed pressed speed (SPD) are first identified. This is accomplished by comparing the processed press speed 132 with the press speeds for each point in the rate curve data block. In the example, these are points $P_3$ and $P_4$ and the proper % flow value (%) is calculated by interpolating between these points as follows:

$$\% = \frac{(Y_3 * (X_4 - \mathrm{SPD})) - (Y_4 * (X_3 - \mathrm{SPD}))}{(X_4 - X_3)}$$

Where:

$Y_3$ is the flow percent for $P_3$ $X_3$ is the press speed for $P_3$ $Y_4$ is the flow percent for $P_4$ $X_4$ press speed for $P_4$ SPD is the processed press speed.

A program listing for calculating the % flow value as described above is provided in Appendix B and the program listing for converting it and outputting it to the PIC 70 and 72 is provided in Appendix C.

Referring particularly to FIG. 13, the pulse width of each nozzle 30 is altered each time the status word 150 in its associated nozzle data record indicates that a change is requested as indicated at process block 307. A more detailed description of how such changes are implemented will now be made with reference to FIG. 15. A listing of the program for carrying out this function is also provided in Appendix D.

Figure 15:
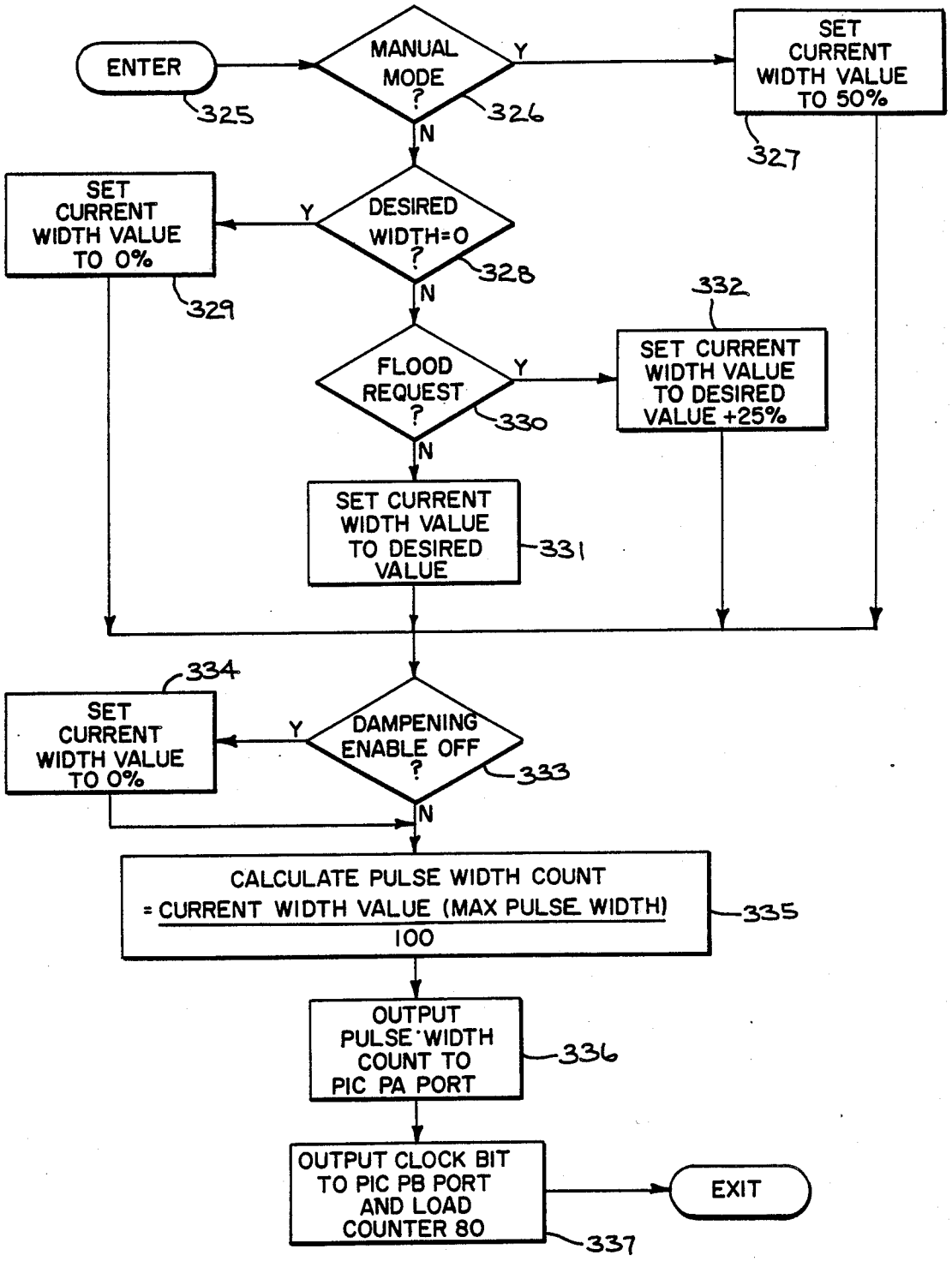
FIG. 15 is a flow chart of the program that changes nozzle pulse width which forms part of the flow chart of FIG. 13.

Referring particularly to FIG. 15, when the system is entered at 325, a check is made to determine the mode of operation. If the dampening control system is in the manual mode, the system branches at decision block 326 and the current pulse width value is set to its midpoint, or 50% value, at process block 327. Otherwise, a check is made at decision block 328 to determine if the desired pulse width has been set to zero, and if it has, the current width value is also set to zero at process block 329. A check is next made at decision block 330 to determine if the flood request flag 129 has been set. If not, the current width value 151 is set to the desired width value 152 (FIG. 9C) at process block 331. If flood request is present, the current width value is set to the desired value plus a 25% flood increment as indicated at process block 332. And finally, a check is made at decision block 333 to determine if the dampening system enable switch 124 (FIG. 8) off. If so, the current width value is set to zero as indicated at process block 334.

The current width value is a percentage which is converted to an 8-bit binary pulse width count before being output. This is illustrated at process block 335 where the "MAX PULSE WIDTH" is a value of 100 in the preferred embodiment that produces a maximum pulse width of 50 milliseconds. The calculated pulse width count is then written to the PA port of the PIC 70 or 72 (FIG. 6) as indicated by process block 336. An 8-bit bit pattern in which a logical "1" is directed to the counter 80 associated with the nozzle 30 is then written to the PB port of the PIC 70 or 72 and applied to the counters 80 as indicated by process block 337. As discussed above with reference to FIG. 6, the 8-bit binary pulse width count at the PA port of the PIC 70 or 72 is stored in the counter 80 which receives the logic "1" from the PB port. As also explained above with respect to FIG. 13, this process is repeated for each nozzle 30 on the spraybar 26 and the counters 80 are thus separately preset with specific pulse width counts.

Appendix A

© 1988 Rockwell International Corporation

```
void feedback_p( )              /* feedback handler process */

 {

  unsigned short inputs_check;                          /* count value for input check interval                          */
  register unsigned short input_count;                  /* present count value for input check time                      */
  unsigned short timer_tick;                            /* count value for timer decrement interval                      */
  register unsigned short timer_count;                  /* present count value for timer decrement counter               */
  unsigned short speed_check;                           /* count value for speed signal check interval                   */
  register unsigned short speed_count;                  /* present count value for speed check time                      */
  unsigned short reg_check;                             /* count value for register check interval                       */
  unsigned short reg_count;                             /* present count value for register check time                   */
  register unsigned char couple;                        /* logical couple number                                         */
  unsigned char speed_status;                           /* press speed change status value                               */
  unsigned int switches;                                /* switch inputs                                                 */


  inputs_check = pi_getticks( INPUT_SCAN_TIME );        /* initialize input check time                                   */
  input_count = inputs_check;
  timer_tick = pi_getticks( TIMER_RESOLUT );            /* initialize timer decrement timing                             */
  timer_count = timer_tick;
  speed_check = pi_getticks( SPEED_SCAN_TIME );         /* initialize speed check interval                               */
  speed_count = speed_check;
  reg_check = pi_getticks( REG_SCAN_TIME );             /* initialize register check interval                            */
  reg_count = reg_check;

  for ( ; ; )                   /* do forever */
    {
       timer_count--;           /*      decrement timer modify counter value    */
       speed_count--;           /*      decrement speed check count value       */
       input_count--;           /*      decrement input check count value       */
       reg_count--;             /*      decrement register check count value    */

       if ( speed_count == 0 )                          /*      IF speed check count value is zero              */
         {
              speed_count = speed_check;                /*      reset speed check counter value to the desired interval value
                                                                                  for checking for speed changes          */
              speed_status = read_press_spd();          /*              read press speed by calling READ_PRESS_SPD      */
              if ( speed_status == CHANGED )            /*              IF press speed has changed from last reading    */
              for ( couple = 0; couple < MAX_COUPLES; couple++ )
                {
                     if ( config_db.log_couple_tbl[couple] == CONFIGURED )
                       {
                                  /*      set rate curve update flag in rate curve database to
                                                  indicate that a new rate curve value needs to be determined.    */
                          rate_curve_db[DAMP][couple].curve_update_flag = ON;
                          set_event(                            /* Signal an event flag for the couple to control process */
                                    &p_control[DAMP][couple],   /* Pass the address of structure for control process info */
                                    couple);                    /*  and the logical couple number */

                          rate_curve_db[INK][couple].curve_update_flag = ON;
                          set_event(                            /* Signal an event flag for couple to control process   */
                       }                            &p_control[INK][couple],    /* Pass the address of structure for control process info */
                }                                   couple);                    /*  and the logical couple number */
         }
       if (input_count == 0 )                   /*      IF input check count value is zero, it is time to       */
         {                                      /*                      update the input databases              */
              input_count = inputs_check;       /*              re-set input check count value to provide next
                                                                      time interval before checking again     */
```

```
        switches = get_inputs();          /*      get all switch inputs                                   */
        check_wash_in(switches);          /*              check wash switch inputs - call CHECK_WASH_IN   */
        check_purge_in(switches);         /*              check purge switch inputs - call CHECK_PURGE_IN */
        check_flood_in(switches);         /*              check flood switch inputs - call CHECK_FLOOD_IN */
        check_aflood_in(switches);        /*              check autoflood switch inputs - call CHECK_AFLOOD_IN    */
        check_damp_en_in(switches);       /*              check dampening system enable switch inputs - call
                                                                CHECK_DAMP_EN_IN                        */
        check_ink_en_in(switches);        /*              check inkrate system enable switch inputs - call
                                                                CHECK_INK_EN_IN                 */
    }
  if (timer_count == 0 )                  /*      IF timer modify count value is zero, it is time to update the timers    */
    {
        timer_count = timer_tick;         /*              re-set timer modify count value to provide next time interval
                                                                before next timer decrement             */
        for ( couple = 0; couple < MAX_COUPLES; couple++ )      /* for each possible couple                     */
          {
                if ( config_db.log_couple_tbl[couple] == CONFIGURED )   /* which is configured for this unit            */
                  {
                        if ( purge[couple].time_count != 0 )    /* IF purge timer for couple is not already at zero     */
                          {
                                purge[couple].time_count--;             /*      decrement purge timer value             */
                                if ( purge[couple].time_count == 0 )    /*      IF purge timer value is now zero        */
                                  {
                                        set_event(              /* Set event flag for couple to the process specified */
                                                &p_msg_hand[INK][couple],       /* structure for Message Handler proc */
                                                couple);                        /*  and the logical couple number */
                                  }
                          }
                        if ( wash[couple].time_count != 0 )     /* IF wash timer for couple is not already at zero      */
                          {
                                wash[couple].time_count--;              /*      decrement wash timer value              */
                                if ( wash[couple].time_count == 0 )     /*      IF wash timer value is now zero         */
                                  {
                                        set_event(              /* Set event flag for couple to the process specified */
                                                &p_msg_hand[INK][couple],       /* structure for Message Handler proc */
                                                couple);                        /*  and the logical couple number */
                                  }
                          }
                        if ( flood[couple].time_count != 0 )    /* IF flood timer for couple is not already at zero     */
                          {
                                flood[couple].time_count--;             /*      decrement flood timer value             */
                                if ( flood[couple].time_count == 0 )    /*      IF flood timer value is now zero        */
                                  {
                                        set_event(              /* Set event flag for couple to the process specified */
                                                &p_msg_hand[DAMP][couple],      /* structure for Message Handler process */
                                                couple);                        /*  and the logical couple number */
                                  }
                          }
                        if ( autoflood[couple].time_count != 0 )/* IF autoflood timer for couple is not already at zero */
                          {
                                autoflood[couple].time_count--;         /*      decrement autoflood timer value         */
                                if ( autoflood[couple].time_count == 0 )/*      IF autoflood timer value is now zero    */
                                  {
                        }               set_event(              /* Set event flag for couple to the process specified */
                                                &p_msg_hand[DAMP][couple],      /* structure for Message Handler process */
                                                couple);                        /*  and the logical couple number */
                }
        }

/*  call register function      */
```

```
        if (reg_count == 0 )                    /*      IF register check count value is zero, it is time to    */
          {                                     /*                      update the register function            */
                reg_count = reg_check;          /*              re-set register check count value to provide next
                                                                        time interval before checking again     */
                reg_threshold(                          /* register handling function   */
                                press_spd_proc,                         /* processed press speed        */
                                (switches & CIRC_EN_MASK));             /* circumferential enable status        */
          }

        pi_wait_anyv(
                        FDBK_EVENT);            /*      Wait for real time clock driven event flag - PI_WAIT_ANYV                */
    }                                           /* End of forever loop */

unsigned int get_press_spd( )           /* obtain press speed period count value                */

{
  register unsigned int press_spd_count;        /* return value         */
  register unsigned short *spd_cnt_ptr;         /* pointer to press speed counter registers             */
  register unsigned short *prev_cnt_ptr;        /* pointer to press speed counter registers             */
  unsigned int counter_value = 0;               /* storage area for press speed counter value           */
  unsigned int previous_value = 0;              /* storage area for previous press speed counter value          */
  register unsigned char *value_ptr;            /* pointer to byte locations of press speed counter storage value       */

  value_ptr = (unsigned char *) &counter_value;         /* point to press speed counter storage value           */
  value_ptr++;                                          /* set to point to location to place first counter value byte   */

  spd_cnt_ptr = (unsigned short *) PRESS_SPD_CNTR;      /* set up pointer to press speed counter registers      */
  *value_ptr = (unsigned char) *spd_cnt_ptr;            /* read first counter byte                              */
  value_ptr++;                                          /* point to next storage byte location                  */
  spd_cnt_ptr++;                                        /* point to next counter register                       */

  *value_ptr = (unsigned char) *spd_cnt_ptr;            /* read next counter byte                               */
  value_ptr++;                                          /* point to next storage byte location                  */
  spd_cnt_ptr++;                                        /* point to next counter register                       */

  *value_ptr = (unsigned char) *spd_cnt_ptr;            /* read next counter byte                               */

  value_ptr = (unsigned char *) &previous_value;        /* point to press speed counter previous value          */
  value_ptr++;                                          /* set to point to location to place first counter value byte   */

  prev_cnt_ptr = (unsigned short *) PRESS_SPD_PRLD;     /* set up pointer to press speed counter preload registers      */
  *value_ptr = (unsigned char) *prev_cnt_ptr;           /* read first preload counter byte                      */
  value_ptr++;                                          /* point to next storage byte location                  */
  prev_cnt_ptr++;                                       /* point to next preload counter register               */

  *value_ptr = (unsigned char) *prev_cnt_ptr;           /* read next preload counter byte                       */
  value_ptr++;                                          /* point to next storage byte location                  */
  prev_cnt_ptr++;                                       /* point to next preload counter register               */

  *value_ptr = (unsigned char) *prev_cnt_ptr;           /* read next counter byte                               */
  if ( counter_value > previous_value )                 /* if the counter has rolled over                       */
        press_spd_count = previous_value + 0x1000000 - counter_value ;  /* take diff from max value + what was left of prev value */
  else
        press_spd_count = previous_value - counter_value;       /* calculate amount counted down for press speed period */

  return(press_spd_count);                              /* return the counter decrement value   */
}
```

```
static void check_flood_in(switches)

unsigned int switches;                  /* switch input port value      */

{

unsigned char flood_in;                                         /* flood input value                    */
register unsigned char couple;                                  /* couple currently being handled       */
static  unsigned int sw_on_count[MAX_COUPLES] = { 0,0 };        /* switch on time counter               */
static  const unsigned int flood_mask[] =                       /* flood switch mask per couple         */
         {
          FLOOD_CPL0,
          FLOOD_CPL1
         };

          for (couple = 0; couple < MAX_COUPLES; couple++)                      /* for all couples */
            {
             if ( config_db.log_couple_tbl[couple] == CONFIGURED )          /*  do if this couple is configured     */
               {
                if ((flood_mask[couple] & switches) == SWITCH_OFF)          /* if the flood switch bit for couple is off    */
                  {
                        flood_in = OFF;                                     /*     set the flood input value to off         */
                        sw_on_count[couple] = 0;                            /* clear the switch on time counter             */
                  }
                else
                  {
                        flood_in = ON;                                      /* else, set the flood input value to on        */
                        sw_on_count[couple]++;                                      /*  increment switch on counter         */
                        if (sw_on_count[couple] > MAX_FLOOD_CNT)                    /* if it has been on too long           */
                          {
                                flood_in = OFF;                                     /* set the flood input off      */
                                if (sw_on_count[couple] == MAX_FLOOD_CNT + 1)   /* The first time that we force input off       */
                                        log(FLOOD_TIMEOUT,                      /* Log that the flood is coming off.            */
                                            NULL,
                                            fdbk_err_list);
                          }
                  }

                if ( flood_in != flood[couple].sw_input )                   /* if the input value read is different than the
                                                                                   present database value                    */
                  {
                        flood[couple].sw_input = flood_in;      /* update the database value                                    */
                  }     set_event(                        /* Set an event flag for the couple specified          */
                              &p_msg_hand[DAMP][couple],  /* Pass the address of the structure for the Message Handler process info */
                              couple);                    /*  and the logical couple number */
               }
return;

}

        static void check_aflood_in(switches)

        unsigned int switches;                  /* switch input port value      */

        {

        unsigned char aflood_in;                                        /* aflood input value                   */
        register unsigned char couple;                                  /* couple currently being handled       */
        static  unsigned int sw_on_count[MAX_COUPLES] = { 0,0 };        /* switch on time counter               */
```

```
for (couple = 0; couple < MAX_COUPLES; couple++)                                    /* for all couples */
  {
   if ( config_db.log_couple_tbl[couple] == CONFIGURED )                  /*  do if this couple is configured     */
     {
      if ((AFLOOD_MASK & switches) == SWITCH_OFF)                    /* if the aflood switch bit for couple is off   */
        {
              aflood_in = OFF;                                  /*     set the aflood input value to off              */
              sw_on_count[couple] = 0;                          /*      clear the switch on time counter              */
        }
      else
        {
              aflood_in = ON;                                   /* else, set the aflood input value to on             */
              sw_on_count[couple]++;                                    /*  increment switch on counter              */
              if (sw_on_count[couple] > MAX_AFLOOD_CNT)                 /* if it has been on too long                */
                      {
                      aflood_in = OFF;                                  /* set the autoflood input off               */
                      if (sw_on_count[couple] == MAX_AFLOOD_CNT + 1)  /* The first time that we force input off      */
                              log(AUTOFLOOD_TIMEOUT,                  /* Log that the autoflood is coming off.       */
                                      NULL,
                                      fdbk_err_list);
                      }
        }

      if ( aflood_in != autoflood[couple].sw_input )          /* if the input value read is different than the
                                                                        present database value                     */
        {
              autoflood[couple].sw_input = aflood_in;         /* update the database value                          */

              set_event(                                      /* Set an event flag for the couple specified         */
                          &p_msg_hand[DAMP][couple],        /* Pass address of structure for Message Handler proc info */
                          couple);                                                  /*  and the logical couple number */
        }
     }
   }
return;

}


static void check_damp_en_in(switches)

unsigned int switches;                  /* switch input port value      */

{

register unsigned char couple;                          /* couple currently being handled       */
register unsigned int damp_enable;                      /* value of the couples dampening enable input  */

static  const unsigned int damp_en_mask[] =             /* dampening enable switch mask per couple              */
         {
          DAMP_EN_CPL0,
          DAMP_EN_CPL1
         };

          for (couple = 0; couple < MAX_COUPLES; couple++)                          /* for all couples */
            {
             if ( config_db.log_couple_tbl[couple] == CONFIGURED )              /*  do if this couple is configured     */
               {
```

```
            if ((damp_en_mask[couple] & switches) == SWITCH_OFF)    /* if the dampening enable switch bit for couple is off */
                    damp_enable = OFF;                              /*     set the input value to off                        */
            else
                    damp_enable = ON;                               /* else, set the input value to on      */

            if ( damp_enable != system_enable[DAMP][couple] )       /* if the enable input has changed value                 */
              {
                    system_enable[DAMP][couple] = damp_enable;                    /* set the input value in database      */
                    set_event(                              /* Signal an event flag for the couple the control process      */
                              &p_control[DAMP][couple],     /* Pass the address of the structure for the control process info */
                              couple);                      /*  and the logical couple number */
              }
            }
        }
return;

}

static unsigned char read_press_spd()

{
unsigned char   press_spd_status;                   /* press speed return status                                          */
static unsigned char    wait_count = 0;             /* counter value for determining time waited for press speed cycle    */
static unsigned char    zero_spd_flag = ON;         /* flag to indicate that now press speed signal present               */
register unsigned int   press_spd_count;            /* press speed timer count value                                      */
register unsigned int   speed_diff;                 /* press speed difference value                                       */

if (((press_spd_count = get_press_spd()) == 0)  /*  IF counter value has not changed from initial value        */
    || read_tin_input() == ON)                  /*    or IF TIN input is high                                  */
  {
        if (wait_count > MAX_WAIT)                  /*    if the counter is greater than the maximum wait for cycle        */
          {
                press_spd_inst = 0;                 /*      set instantaneous press speed to zero                          */
                zero_spd_flag = ON;                 /*      set the flag to indicate no speed signal present               */
                if (read_tin_input() == OFF)        /*      IF TIN input is low                                            */
                  {
                        en_speed_in();              /*              re-enable the press speed input by calling EN_SPEED_IN */
                        wait_count = 0;             /*              clear the wait count value                              */
                  }
          }
        else
          wait_count++;                             /*    increment wait for cycle completion counter                      */
  }
else if (zero_spd_flag == ON ||                     /*            IF zero speed flag is set or the count value is too low, */
        press_spd_count < SPD_COUNT_MIN)            /*   throw this reading away and set up to allow use of the next reading */
  {
        zero_spd_flag = OFF;                        /*              clear the zero speed flag                               */
        en_speed_in();                              /*              re-enable the press speed input by calling EN_SPEED_IN  */
        wait_count = 0;                             /*              clear the wait count value                              */
  }
else                                                /*            ELSE we have a usable count value                         */
  {
        press_spd_inst =                            /*              calculate instantaneous press spd and store in database */
                SPEED_FACTOR / press_spd_count ;
        en_speed_in();                              /*              re-enable the press speed input by calling EN_SPEED_IN  */
        wait_count = 0;                             /*              clear the wait count value                              */
  }
press_spd_status = NOT_CHANGED;                     /*      speed status = not changed                                      */
```

```
if ( press_spd_inst > press_spd_proc )          /* insure that speed difference value is positive                    */
        speed_diff = press_spd_inst - press_spd_proc;
else
        speed_diff = press_spd_proc - press_spd_inst;

if ( speed_diff > press_spd_proc / JITTER_FACTOR )      /* IF instantaneous press speed has varied
                                                                from processed press speed by more than allowed amount  */
  {
        press_spd_status = CHANGED;             /*        set speed status = changed                                       */
        press_spd_proc = press_spd_inst;        /*        set processed press speed to instantaneous press speed           */
  }

return( press_spd_status );                     /* return status indicating whether press speed has changed               */
}
```

Appendix B

© 1988 Rockwell International Corporation

```
void calc_curve( subsystem, logical_couple)     /* call the function to calculate a new curve value */

unsigned char   subsystem;                                  /* subsystem type        */
unsigned char   logical_couple;                             /* logical couple number */

{
        register unsigned int press_speed;                  /* storage location for press speed                          */
        register unsigned char number_points;               /* number of curve points defining the rate curve            */
        register struct curvpt *curvept_ptr;                /* pointer to curve point structure                          */
        register int curve_value;                           /* intermediate curve value storage                          */
        register unsigned int db_curve_value;               /* intermediate database curve value storage                 */

        press_speed = press_spd_proc;                       /* get processed press speed, which is
                                                            in impressions per hour, while the rate curve point press
                                                            speed value is in thousands of inpressions per hour       */

        number_points = rate_curve_db[subsystem][logical_couple].numb_curve_pts;        /* get the number of curve points which
                                                                                            define the rate curve         */
        curvept_ptr = &rate_curve_db[subsystem][logical_couple].curve_pt[0];            /* initialize the curve point structure
                                                                                            pointer to point to the first curve
                                                                                            point defined in data base    */
        if (press_speed < (curvept_ptr->press_speed * 1000))        /* if the press speed is
                                                                    below the press speed value for the lowest defined curve
                                                                    point, interpolate on speed from zero to the minimum pt */

                curve_value =
                  curvept_ptr->flow_percent * press_speed                   /* intermediate rate curve value which is      */
                   / ( curvept_ptr->press_speed ) ;                         /* 1000 * the actual curve percent value since */
                                                                            /* press speed in iph and curve pt in kiph     */

                                                            /* else if the press speed is beyond the maximum defined
                                                               curve point press speed, use the same slope as last point
                                                               to calc. percent value ( * 1000 for more resolution)      */
        else if (press_speed >= (curvept_ptr + number_points - 1)->press_speed * 1000)
          {
                curvept_ptr += (number_points - 1);         /* curve point structure pointer to last defined point       */
                if ( (curvept_ptr->press_speed - (curvept_ptr - 1)->press_speed) == 0 )
                        curve_value = curvept_ptr->flow_percent * 1000;
                else
                        curve_value =                       /* intermediate curve value                                  */
                  curvept_ptr->flow_percent * 1000 +                        /* last curve point flow percent value       */
                  ( (curvept_ptr->flow_percent - (curvept_ptr - 1)->flow_percent)   /*  plus last slope * press speed    */
                    * (press_speed - curvept_ptr->press_speed * 1000)       /*  difference from last press speed          */
                    / ((curvept_ptr->press_speed - (curvept_ptr - 1)->press_speed) )  /*  point specified                 */
                  );
                if (curve_value > MAX_CURVE_VAL)                            /* insure curve value not greater than       */
                        curve_value = MAX_CURVE_VAL;                        /*  max. percent ( *1000 )                   */
                else if (curve_value < MIN_CURVE_VAL)                       /* insure that value not less than min.      */
                        curve_value = MIN_CURVE_VAL;                        /*  percent ( *1000 )                        */

/*      for use if a flat line across at highest specified curve point
/*              curve_value =                                                                                             */
/*                curvept_ptr->flow_percent * 1000 ;                                                                      */

          }
        else
          {                                                         /* else, we are in between defined curve points      */
                                                            /* starting with the first curve point, increment curve point
                                                               structure pointer until it finds the first point which has
                                                               a larger press speed value than present press speed       */
                for ( ;
                     ((curvept_ptr + 1)->press_speed * 1000) < press_speed ;
                     curvept_ptr ++);
```

```
                        /* interpolate between the point determined and the one above it by the following
                    equation,

                value = (Ya * ( Xb - spd )) - (Yb * ( Xa - spd))
                        ----------------------------------------
                                        Xb - Xa

                                                where point b is the upper curve point defined
                                                      point a is the lower curve point defined
                                                      Yb is the flow value defined for point b
                                                      Ya is the flow value defined for point a
                                                      Xb is the press speed value defined for point b
                                                      Xa is the press speed value defined for point a
                                                      spd is the current press speed value

                                        the actual flow value determined will be the interpolated rate curve percent
                                        flow value times 1000 because of press speed being in iph and the curve press
                                        speed being in kiph (used for greater resolution)
                                                                                                                  */
        if ( (curvept_ptr + 1)->press_speed - curvept_ptr->press_speed == 0 )
                curve_value = (curvept_ptr + 1)->flow_percent * 1000;
        else
                curve_value =
        (
         (curvept_ptr->flow_percent *
          (((curvept_ptr + 1)->press_speed * 1000 ) - press_speed))
         -
         ( (curvept_ptr + 1)->flow_percent *
           ( (curvept_ptr->press_speed * 1000 ) - press_speed)
         )
        )
        /
          (( (curvept_ptr + 1)->press_speed - curvept_ptr->press_speed ) ) ;    /* to give us the 1000 times interpolated
                                                                                    flow percent value from the rate curve */
  }
db_curve_value =
        curve_value / CURVE_DIVIDE;                                     /* divide intermediate curve value by curve
                                                                        factor to give desired database curve value      */
if ((curve_value % CURVE_DIVIDE) > ( CURVE_DIVIDE / 2 ))                /* round off the stored database value if           */
        db_curve_value ++;                                              /*                    necessary                    */

rate_curve_db[subsystem][logical_couple].curve_value = db_curve_value;  /* store into database                              */

return;
}
```

Appendix C

© 1988 Rockwell International Corporation

```
static unsigned char spray_freq( logical_couple )                    /* determine spray frequency */

register unsigned char  logical_couple;                                  /* logical couple number                    */
{
        register unsigned long          counter_val;
        static unsigned long    last_ctr_val[MAX_COUPLES];
        unsigned char           freq_percent;                    /* percent of frequency range value output */

        if ( control_db[DAMP][logical_couple].operating_mode == AUTOMATIC )     /* IF the dampening couple is in automatic mode */
          {
                                /*  output counter value = counter value for minimum frequency -                          */
                                /*    ((counter value for minimum frequency - counter value for maximum frequency) / 100) *     */
                                /*                curve percent value                                                       */
                                                                                                                          */
                counter_val = COUNT_FACTOR / ( COUNT_OFFSET + ( CURVE_FACTOR
                                        * rate_curve_db[DAMP][logical_couple].curve_value) );   /* use 1000 to
                                                                                        divide because curve_value is 10 x      */
                freq_percent = rate_curve_db[DAMP][logical_couple].curve_value / 10;            /* frequency range percent value =
          }                                                     curve percent value  (divide curve_value by 10 to get percent)  */
        else
          {                                                     /*      ELSE the couple is in manual mode       */
                                /*  output counter value = counter value for minimum frequency -                          */
                                /*    ((counter value for minimum frequency - counter value for maximum frequency) / 100) *     */
                                /*                desired percent value                                                     */
                                                                                                                          */
                counter_val = COUNT_FACTOR / ( COUNT_OFFSET + ( CURVE_FACTOR
                                *  control_db[DAMP][logical_couple].desired_value[0] * 10) ) ;

                freq_percent = control_db[DAMP][logical_couple].desired_value[0];       /* frequency range percent value =
                                                                                                desired percent value           */
          }
        if ( counter_val != last_ctr_val[logical_couple] )                      /* if the counter value has changed                */
          {
                last_ctr_val[logical_couple] = counter_val;                     /* save it as the last counter value output        */
                set_pulse_freq(                                                 /* and output it to the hardware                   */
                                logical_couple,
                                counter_val);
          }

        return ( freq_percent );                                        /*      return output frequency range percent value     */
}
```

```
void set_pulse_freq( logical_couple, counter_val)                /* set pulse frequency                          */

        unsigned char   logical_couple;                                  /* logical couple number                        */
        unsigned long   counter_val;                                     /* counter value                                */

{
        register unsigned short                 *counter_ptr;                    /* pointer to counter registers                 */
        register unsigned char                  *value_ptr;                      /* pointer to value bytes                       */

        static const unsigned short     *freq_load_adr[] =       /* address to load spray frequency value to     */
          {
                (unsigned short *)SPRY_FREQ_ADR0,                /* couple 0 spray frequency address             */
                (unsigned short *)SPRY_FREQ_ADR1                 /* couple 1 spray frequency address             */
          };


                counter_ptr = (unsigned short *)freq_load_adr[logical_couple];
                                                                 /* load pointer with begining addr. of counter registers */
                value_ptr = (unsigned char *) &counter_val;      /* load value pointer with address of first usable byte */

                *counter_ptr = *(value_ptr + 1);                 /* write value to first register                 */
                *(counter_ptr + 1) = *(value_ptr + 2);           /* write second value to second register         */
                *(counter_ptr + 2) = *(value_ptr + 3);           /* load final value into timer for this output frequency */

                spray_freq_cnt[logical_couple] = counter_val;
  return;
}
```

Appendix D

© 1988 Rockwell International Corporation

```
static void spray_request( logical_couple, element, flood_status, freq_percent )

register unsigned char  logical_couple;                          /* logical couple number                          */
register unsigned char  element;                                 /* logical element number                         */
unsigned char   flood_status;                                    /* status of flood requests                       */
unsigned char   freq_percent;                                    /* spray frequency range percentage               */

{
        unsigned short  pulse_width;                             /*                                                */

                /*  set the normalized current value to the control database's desired value    */

        control_db[DAMP][logical_couple].norm_curr_value[element] = control_db[DAMP][logical_couple].desired_value[element];

        if ( control_db[DAMP][logical_couple].operating_mode == MANUAL )        /*  IF the couple is in manual operating mode   */
          {
                control_db[DAMP][logical_couple].control_value[element] = MIDPOINT_CV;  /* control value = midpoint of range    */
                control_db[DAMP][logical_couple].norm_curr_value[element] = MIDPOINT_CV;/* control value = midpoint of range    */
                control_db[DAMP][logical_couple].curr_value[element] = freq_percent;    /* control value = midpoint of range    */
          }

        else if ( control_db[DAMP][logical_couple].desired_value[element] == 0 )        /* ELSE IF desired value is zero        */
                control_db[DAMP][logical_couple].control_value[element] = 0;            /*  set the control value to zero       */

        else if ( flood_status == FLOOD_ON )                                            /* ELSE IF flood status indicates flood */
          {
                control_db[DAMP][logical_couple].control_value[element] =               /*  control value = desired value +      */
                        control_db[DAMP][logical_couple].desired_value[element] + FLOOD_INC;    /*   the flood increment value  */
                if (control_db[DAMP][logical_couple].control_value[element] > MAX_CTL_VAL )     /*  IF control value > maximum  */
                        control_db[DAMP][logical_couple].control_value[element] = MAX_CTL_VAL;  /*      allowed control value,  */
          }                                                                     /*    control value = maximum allowed control value     */

        else
          control_db[DAMP][logical_couple].control_value[element] =             /* control value = the desired value             */
                control_db[DAMP][logical_couple].desired_value[element];


        if ( system_enable[DAMP][logical_couple] == OFF )       /* IF the dampening system enable input is off          */

                pulse_width = MIN_PULSE_CNT;                                            /*   Set pulse width value to zero      */
        else
                        /*  calculate the pulse width output value for this element ..          */
          {
                calc_pulse_width(                               /* by calling the pulse width calculation function      */
                                logical_couple,                 /*    passing the logical couple number                 */
                                element,                        /*    and the logical element number                    */
                                &pulse_width);                  /*    and the location to place the result into         */
          }

        set_pulse_width(                                        /* output pulse width to hardware                       */
                        logical_couple,                         /*  passing couple number                               */
                        element,                                /*  and element number                                  */
                        pulse_width);                           /*  and the pulse width desired                         */
```

```
        if ( control_db[DAMP][logical_couple].control_status[element] == CHG_REQ_LIMIT )        /* IF control status = change
                                                                                                   request to limits        */
                control_db[DAMP][logical_couple].control_status[element] = CHG_CMPLT_LIM;       /* . set control status = change
                                                                                                   completed to limit       */
        else
                control_db[DAMP][logical_couple].control_status[element] = CHNG_COMPLETE;       /* set control status =
                                                                                                   change complete          */
        if ( control_db[DAMP][logical_couple].operating_mode == AUTOMATIC )     /* since current value for manual mode was already set above
                                                                                                   /*  IF couple is in automatic operating mode    */
                control_db[DAMP][logical_couple].curr_value[element] =                          /* set current value = control value    */
                        control_db[DAMP][logical_couple].control_value[element] ;
        return ;
}

static void calc_pulse_width( logical_couple, logical_elem, pulse_width_ptr)        /* calculate pulse width */

register unsigned char  logical_couple;                                 /* logical couple number                        */
register unsigned char  logical_elem;                                   /* logical element number                       */
unsigned short  *pulse_width_ptr;                                       /* pointer to pulse width value                 */

{
        register unsigned short pulse_width;                            /* temporary storage for pulse width            */

                /*  set the pulse width output value for this element .. pulse width value =
                                (control value * max. pulse width time / maximum control value
                                                                                                                        */
                pulse_width = control_db[DAMP][logical_couple].control_value[logical_elem] * MAX_PULSE_CNT / 100;

                if (pulse_width < MIN_PULSE_CNT)
                        pulse_width = MIN_PULSE_CNT;                    /* insure that the pulse width calculated is not less   */
                                                                        /*      than the minimum allowed                        */
                *pulse_width_ptr = pulse_width;                         /* put calculated value at at calling function location */

                return;
}

void set_pulse_width(logical_couple, logical_elem, pulse_width)

register unsigned char logical_couple;                  /* logical couple number        */
register unsigned char logical_elem;                    /* logical element number       */
register unsigned short pulse_width;                    /* pulse width value            */

{
        static const char nozzle_mask[] =               /* masks for each of the spray nozzles          */
         {
          NOZZLE_1,
          NOZZLE_2,
          NOZZLE_3,
          NOZZLE_4,
          NOZZLE_5,
          NOZZLE_6,
          NOZZLE_7,
          NOZZLE_8
         };
        static const unsigned short     *pulse_load_adr[MAX_COUPLES] =  /* address to load pulse width value to         */
         {
```

```
        (unsigned short *)SPRY_PULS_ADR0,                          /* spray pulse width couple 0 address          */
        (unsigned short *)SPRY_PULS_ADR1                           /* spray pulse width couple 1 address          */
    };
    static const unsigned short     *clk_pulse_adr[MAX_COUPLES] =  /* address to clock pulse width value at       */
    {
        (unsigned short *)SPRY_CLKP_ADR0,                          /* pulse width clocking couple 0 address       */
        (unsigned short *)SPRY_CLKP_ADR1                           /* pulse width clocking couple 1 address       */
    };

    register unsigned short *clock_ptr;
    register unsigned short *pulse_ptr;                            /* pointer to clocking port                    */
                                                                   /* pointer to pulse value load port            */

    pulse_ptr = (unsigned short *)pulse_load_adr[logical_couple];  /*  determine address to load the pulse value for couple */
    *pulse_ptr = ~ pulse_width ;                                   /*  output pulse width value to counter     */
                                                                   /*  value must be one's complement representation, so invert */

    clock_ptr = (unsigned short *)clk_pulse_adr[logical_couple];   /*  address to load clocking bit into           */
    *clock_ptr = nozzle_mask[logical_elem];                        /*  now we clock the pulse value into the proper nozzle counter  */
    *clock_ptr = 0xff;                                             /*  return clock port to fully clear state      */

    spray_pulse[logical_couple][logical_elem] = pulse_width;

return;
}
```

We claim:

1. A damprate control system for operating a set of nozzles on a spraybar for a printing press, which comprises:

memory means for storing rate curve data which is employed to control the operation of the nozzles;

interface circuit means coupled to the set of nozzles and being responsive to a pulse rate signal to turn on all of said nozzles at the indicated pulse rate;

processor means coupled to said memory means and said interface circuit means to calculate a pulse rate from said stored rate curve data and to output a corresponding pulse rate signal to said interface circuit means; and communications means coupled to said memory means and being operable in response to a received rate curve message to alter the rate curve data stored in the memory means.

2. The damprate control system as recited in claim 1 in which the stored rate curve data includes a plurality of points and each point indicates the amount of dampening water required at a specific press speed.

3. The damprate control system as recited in claim 1 in which the interface circuit means includes counter means for controlling the time interval each nozzle remains on, the memory means stores data which indicates the desired interval each nozzle is to remain on, the communications means is responsive to a received change message to alter the stored desired interval data, and the processor means is operable to preset the counter means with a value that is determined by the current value of the stored desired interval data.

4. The damprate control system as recited in claim 3 in which the counter means includes a separate counter for each nozzle, the stored desired interval data includes associated separate data for each nozzle, and the processor means presets each separate counter when its associated separate data is altered by said communications means.

5. The damprate control system as recited in claim 3 in which a flood request flag is stored in said memory means, the communications means is responsive to a flood request message to set the flood request flag, and the processor means is operable when the flood request flag is set to increase by a fixed amount the value employed to preset the counter means.

6. A damprate control system for operating a set of nozzles on a spraybar for a printing press, which comprises:

memory means for storing rate curve data which is employed to control the operation of the nozzles, the rate curve data including a set of points, each of which points is defined by a press speed number and a flow number;

interface circuit means coupled to the set of nozzles and being responsive to a pulse rate signal to turn on all of said nozzles at the indicated pulse rate;

speed feedback means coupled to the press and being operable to provide a signal indicative of press speed; and processor means coupled to the speed feedback means, the memory means, and the interface circuit means, the processor means being operable to produce a pulse rate signal for the interface circuit means which has a value that is determined by interpolating between the two points in the stored rate curve data whose press speed numbers straddle the press speed indicated by the speed feedback means.

7. The damprate control system as recited in claim 6 in which the pulse rate value is determined by linearly interpolating between the two points in the stored rate curve data as follows:

$$\text{Pulse Rate Value } \alpha \frac{(Y_3 * (X_4 - \text{SPD})) - (Y_4 * (X_3 - \text{SPD}))}{(X_4 - X_3)}$$

Where:

$Y_3$ and $Y_4$ are the flow numbers for the respective two points, $X_3$ and $X_4$ are the press speed numbers for the respective two points, SPD is the press speed indicated by the speed feedback means.

8. The damprate control system as recited in claim 6 in which the memory means stores an update flag, and the system further includes:

communications means coupled to said memory means and being operable in response to a received rate curve message to alter the rate curve data stored in the memory means and to set the update flag; and in which the processor means is operable in response to a set update flag to produce updated pulse rate signal using the altered rate curve data.

9. The damprate control system as recited in claim 6 in which the memory means stores a processed speed value indicative of the press speed signal from the speed feedback means, and in which the speed feedback means is operable to alter the stored processed speed value when the press speed changes by a preestablished amount and in which the processor means is operable in response to the alteration of the processed speed value to produce an updated pulse rate signal using the altered processed speed value.

10. The damprate control system as recited in claim 6 in which the interface circuit means includes counter means for controlling the time interval each nozzle remains on, the memory means stores data which indicates the desired interval each nozzle is to remain on, and the processor means is operable to preset the counter means with a value that is determined by the value of the stored desired interval data.

11. A damprate control system for operating a set of nozzles on a spraybar for a printing press, which comprises:

memory means for storing desired width values, one desired width value being associated with each nozzle on the spraybar;

interface circuit means coupled to the set of nozzles and being responsive to a pulse rate signal to turn on all of said nozzles and including a set of counters, each for controlling the duration that a respective one of said nozzles remains on and each being presettable to a count value which determines the duration;

processor means coupled to said memory means and said interface circuit means to produce a pulse rate signal for the interface circuit means and for producing a count value for each of the counters in the interface circuit means, which count values are each determined by a corresponding one of the desired width values stored in said memory means; and communications means coupled to said memory means and being responsive to a received change message to alter one of the desire width values stored in said memory means.

12. The damprate control system as recited in claim 11 in which the memory means stores status flags, one status flag being associated with each stored desired width value, in which the communications means sets the status flag associated with any desired width value that it alters, and in which the processor means is responsive to the setting of one of said status flags to produce a new count value that is determined by the associated altered desired width value.

13. The damprate control system as recited in claim 11 in which the interface circuit means includes:

a pulse generating means which is responsive to the pulse rate signal received from the processor means to produce a pulse stream at the rate indicated by said pulse rate signal; and a set of flip-flops, each flip-flop being coupled to operate one of the nozzles and having one input connected to the output of the counter associated with that nozzle and a second input coupled to receive the pulse stream;

wherein said flip-flops are set when they receive each pulse in said pulse stream to turn on the nozzles, and each flip-flop is separately reset by its associated counter to turn off its associated nozzle.

14. The damprate control system as recited in claim 13 in which the interface circuit means includes pulse delay means which receives the pulse stream and delays the application of said pulse stream to alternate ones of said flip-flops such that the turning on of alternate ones of the nozzles on the spraybar is delayed.

15. In a press control system for operating press elements as a function of press speed, a press speed feedback circuit which comprises:

a feedback device connected to sense press motion and produce an electrical pulse for each increment of press motion;

a counter having an input connected to receive the electrical pulses from the feedback device and to produce an output signal after a predetermined number of electrical pulses have been received;

a timer having an input for receiving a control signal which turns the timer on and off and a set of output terminals which produce signals that indicate the value of the timer as a digital number which can be read by a processor in the press control system; and control means having one input for receiving from the processor a signal which initiates a speed sample cycle, having a second input connected to receive the output signal from the counter, and having an output which produces the control signal for the input of the timer, said control means being operable upon receiving the signal initiating a speed sample cycle for turning the timer on when the next output signal is received from the counter and then turning the timer off when the subsequent output signal is received from the counter.

16. The press speed feedback circuit as recited in claim 15 in which the control means includes a flip-flop which is set when the timer is turned on and is-reset when the timer is turned off.

17. A damprate control system for a printing press, which comprises:

a microprocessor having terminals connected to a data bus and terminals connected to an address bus;

a memory connected to the data bus and the address bus for storing a control database that includes data structures that are employed to determine the amount of dampening water to be produced;

interface circuit means connected to the data bus and the address bus and connected to operate a dampening water mechanism on the printing press in response to damprate control signals received through the data bus;

a communication link coupled to the data bus and being operable to receive message data from a work station which indicates the alteration of data structures in the memory; and control program storage means for storing a control program which is executed by the microprocessor to carry out the following functions:

(a) read messages received by the communications link and alter the data structures in the memory as indicated by the received messages; and (b) calculate damprate control signals using the data structures stored in the memory and writing these damprate control signals to the interface circuit means.

18. The damprate control system as recited in claim 17 which includes a press speed interface circuit connected to the data bus and being operable to produce a digital number indicative of printing press speed, and in which the microprocessor executes the control program to:

(c) periodically read the digital number indicative of printing press speed and store it in the memory as one of said data structures.

19. The damprate control system as recited in claim 18 which includes a control panel coupled to the data bus to produce digital signals indicative of the state of switches on the control panel, and in which the microprocessor executes the control program to:

(d) periodically read the digital signals indicative of the state of switches on the control panel and store a switch state in the memory as one of said data structures.

* * * * *